US011730324B2

(12) United States Patent
Osborne, Jr.

(10) Patent No.: US 11,730,324 B2
(45) **Date of Patent: *Aug. 22, 2023**

(54) DISPENSER FOR ROLLED SHEET MATERIALS WITH BELT DRIVE SYSTEM

(71) Applicant: Charles A. Osborne, Jr., Cumming, GA (US)

(72) Inventor: Charles A. Osborne, Jr., Cumming, GA (US)

(73) Assignee: Valve Solutions, Inc., Alpharetta, GA (US)

( * ) Notice: Subject to any disclaimer, the term of this patent is extended or adjusted under 35 U.S.C. 154(b) by 178 days.

This patent is subject to a terminal disclaimer.

(21) Appl. No.: 17/378,968

(22) Filed: Jul. 19, 2021

(65) Prior Publication Data

US 2021/0338018 A1 Nov. 4, 2021

Related U.S. Application Data

(63) Continuation of application No. 16/247,102, filed on Jan. 14, 2019, now Pat. No. 11,071,415.

(Continued)

(51) Int. Cl.
*A47K 10/36* (2006.01)
*A47K 10/32* (2006.01)

(Continued)

(52) U.S. Cl.
CPC ..... *A47K 10/3643* (2013.01); *A47K 10/3656* (2013.01); *A47K 2010/3233* (2013.01);

(Continued)

(58) Field of Classification Search
None
See application file for complete search history.

(56) References Cited

U.S. PATENT DOCUMENTS 266,741 A 10/1882 Weston
3,436,001 A * 4/1969 Bartleson ..... A47K 10/36 225/100

(Continued)

FOREIGN PATENT DOCUMENTS

BR PI1101834 A2 10/2012
CN 2694888 Y 4/2005

(Continued)

OTHER PUBLICATIONS

Notification of Transmittal with International Search Report and Written Opinion for related Application No. PCT/US19/13476, dated Apr. 15, 2019.

(Continued)

*Primary Examiner* — William A. Rivera
(74) *Attorney, Agent, or Firm* — Womble Bond Dickinson (US) LLP

(57) ABSTRACT

The present disclosure is in one aspect to a dispenser for rolled sheet materials. The dispenser includes a feed roller that is rotatably mounted to a housing of the dispenser housing, and that is configured to feed a predetermined amount of sheet material from the supply of sheet material through a discharge provided along the housing of the dispenser. The dispenser also has a feed roller drive assembly with a drive motor, and a belt transmission assembly. The belt transmission assembly has a drive belt coupled to the drive motor and to the feed roller such that rotation of the feed roller is driven by operation of the drive motor.

20 Claims, 32 Drawing Sheets

Related U.S. Application Data

(60) Provisional application No. 62/750,646, filed on Oct. 25, 2018, provisional application No. 62/617,407, filed on Jan. 15, 2018.

(51) Int. Cl.
*B65H 16/06* (2006.01)
*B65H 20/00* (2006.01)
*B65H 20/02* (2006.01)

(52) U.S. Cl.
CPC ..... *A47K 2010/3668* (2013.01); *B65H 16/06* (2013.01); *B65H 20/005* (2013.01); *B65H 20/02* (2013.01); *B65H 2402/30* (2013.01); *B65H 2403/00* (2013.01); *B65H 2403/20* (2013.01); *B65H 2403/92* (2013.01); *B65H 2404/13161* (2013.01); *B65H 2404/143* (2013.01); *B65H 2404/223* (2013.01); *B65H 2601/121* (2013.01); *B65H 2601/255* (2013.01); *B65H 2601/521* (2013.01); *B65H 2701/1924* (2013.01)

(56) References Cited

U.S. PATENT DOCUMENTS

| | | | | |
|---|---|---|---|---|
| 3,881,717 | A | 5/1975 | Dean | |
| 4,170,390 | A | 10/1979 | McCabe | |
| 4,721,265 | A * | 1/1988 | Hawkins | A47K 10/36 250/221 |
| 5,904,283 | A | 5/1999 | Kanbar | |
| 6,651,922 | B1 | 11/2003 | Quimpo | |
| 7,213,782 | B2 | 5/2007 | Osborne | |
| 7,370,824 | B1 | 5/2008 | Osborne | |
| 7,942,290 | B2 | 5/2011 | Halliburton | |
| 8,177,156 | B1 | 5/2012 | Rinne | |
| 8,511,681 | B2 | 8/2013 | Nakata et al. | |
| 9,907,441 | B2 | 3/2018 | Osborne, Jr. et al. | |
| 11,071,415 | B2 | 7/2021 | Osborne, Jr. | |
| 2002/0092633 | A1 | 7/2002 | Odhe et al. | |
| 2010/0051737 | A1 * | 3/2010 | Rodrian | A47K 10/36 312/34.8 |
| 2010/0286817 | A1 | 11/2010 | Goeking et al. | |
| 2011/0266741 | A1 | 11/2011 | Nakata et al. | |
| 2012/0255413 | A1 | 10/2012 | Osborne | |
| 2012/0308288 | A1 | 12/2012 | Tsuchiya et al. | |
| 2013/0307209 | A1 | 11/2013 | Nakata et al. | |
| 2015/0297043 | A1 * | 10/2015 | Osborne, Jr. | A47K 10/38 242/563.2 |
| 2016/0253860 | A1 | 9/2016 | Wilson et al. | |
| 2016/0353945 | A1 | 12/2016 | Osborne | |
| 2016/0353947 | A1 | 12/2016 | Osborne | |
| 2017/0290471 | A1 | 10/2017 | Borke et al. | |
| 2018/0170703 | A1 | 6/2018 | Osborne, Jr. | |
| 2018/0263433 | A1 | 9/2018 | Osborne, Jr. | |
| 2020/0187728 | A1 | 6/2020 | Osborne, Jr. | |
| 2020/0281420 | A1 * | 9/2020 | Johnson | A47K 10/3625 |

FOREIGN PATENT DOCUMENTS

| | | | |
|---|---|---|---|
| CN | 2873064 | Y | 2/2007 |
| CN | 102842173 | A | 12/2012 |
| CN | 102013127 | B | 9/2013 |
| CN | 103426236 | A | 12/2013 |
| CN | 102236933 | B | 1/2014 |
| CN | 102837504 | B | 4/2015 |
| CN | 102842173 | B | 4/2015 |
| CN | 104545643 | A | 4/2015 |
| CN | 103043465 | B | 2/2016 |
| CN | 103426236 | B | 2/2016 |
| CN | 205552645 | U | 9/2016 |
| DE | 3603638 | A1 | 8/1987 |
| DE | 4020707 | A1 | 1/1992 |
| EP | 682492 | B1 | 12/1997 |
| EP | 2383707 | A1 | 11/2011 |
| EP | 2529938 | A2 | 12/2012 |
| EP | 2529938 | A3 | 8/2016 |
| IN | 20110119013 | | 11/2012 |
| JP | 2005000367 | A | 1/2005 |
| JP | 2011233084 | A | 11/2011 |
| KR | 2009104355 | A | 10/2009 |
| KR | 1203959 | B1 | 11/2012 |
| KR | 1214072 | B1 | 12/2012 |
| RU | 2450359 | C1 | 5/2012 |
| RU | 2480836 | C1 | 4/2013 |
| WO | WO2002/075759 | A2 | 9/2002 |
| WO | WO2005/074532 | A2 | 8/2005 |
| WO | WO2007022153 | A3 | 8/2007 |
| WO | WO2008/097094 | A1 | 8/2008 |
| WO | WO2013063731 | A1 | 5/2013 |

OTHER PUBLICATIONS

International Preliminary Report on Patentability and Written Opinion of the International Searching Authority of International Application No. PCT/US2019/013476 dated Jul. 30, 2020.

Extended European Search Report of European Application No. 19739018.0 dated Dec. 21, 2021.

* cited by examiner

DISPENSER FOR ROLLED SHEET MATERIALS WITH BELT DRIVE SYSTEM

CROSS-REFERENCE TO RELATED APPLICATIONS

The present Patent Application is a continuation of previously filed, co-pending U.S. patent application Ser. No. 16/247,102, filed Jan. 14, 2019, which claims the benefit of U.S. Provisional Patent Application No. 62/617,407, filed on Jan. 15, 2018, and U.S. Provisional Patent Application No. 62/750,646, filed on Oct. 25, 2018.

INCORPORATION BY REFERENCE

U.S. patent application Ser. No. 16/247,102, which was filed Jan. 14, 2019, U.S. Provisional Patent Application No. 62/617,407, which was filed on Jan. 15, 2018, and U.S. Provisional Patent Application No. 62/750,646, which was filed on Oct. 25, 2018, are hereby incorporated by reference for all purposes as if presented herein in their entirety.

TECHNICAL FIELD

This disclosure generally relates to dispensers and, more particularly, to electronic dispensers for flexible sheet materials such as paper products.

BACKGROUND

Different types of dispensing devices for controlling quantities of paper products dispensed such as for hospitals, restrooms, and other environments have been developed in recent years. Many of these dispensers include automatic drive mechanisms that drive a feed roller to dispense selected amounts of sheet material. Such automatic drive mechanisms, however, typically employ intermeshing gears that can create significant noise during operation. Additionally, such automatic drive mechanisms may not apply a consistent driving or pulling force engaging and feeding the sheet material, which can result in inconsistent or improper feeding of the sheet material, and/or increased wearing of parts or components of the feed roller. Accordingly, it can be seen that a need exists for an automatic dispenser that provides for a substantially quiet and consistent dispensing or feeding of desired amounts of a sheet material, and which addresses the foregoing and other related and unrelated problems in the art.

SUMMARY

Briefly described, the present disclosure is, in one aspect, directed to a dispenser assembly for dispensing selected amounts of a sheet material, for example, paper products, including, but not limited to, towels, tissue, napkins, etc. The dispenser assembly can include a dispenser housing and a supply of sheet material, such as a roll of sheet material, attached to at least a portion of the dispenser housing, for example, by one or more arms or supports. The dispenser assembly further may include a feed roller that is rotatably mounted within the dispenser housing and generally is configured to feed, drive, or pull a predetermined amount of sheet material of the supply of sheet material through a discharge of the dispenser. The dispenser assembly also generally can include one or more pressing rollers that are biased toward engagement with the feed roller so that the sheet material is urged and/or engaged against the feed roller such that the sheet material is pulled or drawn between the bead and pressing roller(s) during a dispensing operation.

In one embodiment, the dispenser assembly further includes a feed roller drive assembly/system for driving rotation of the feed roller to dispense selected amounts of sheet material. The drive system/assembly can include at least one driving mechanism, including a motor in communication with the feed roller to drive rotation or movement thereof. The drive system/assembly also can include a belt transmission assembly for transferring power between the motor and the feed roller. The belt transmission assembly includes a drive belt extending between the drive motor and feed roller. For example, the drive belt can engage a pulley, sheave or belt gear, or can be attached or otherwise operably coupled to a driveshaft of the motor, and further will be operatively coupled to the feed roller, e.g., by a feed roller pulley.

In one embodiment, the feed roller pulley can be attached to or engaged with the feed roller between the ends of the feed roller; for example, at or near a midpoint of the feed roller body, with the drive belt received about and operably engaging the feed roller for transferring power from the motor to the feed roller for driving rotation of the feed roller. Other coupling and driving arrangements between the feed roller and drive belt can be used, however, without departing from the scope of the present disclosure. The arrangement/positioning of the location/point of engagement where the drive belt engages the feed roller, further generally will be selected to facilitate the application of a substantially consistent drive force along the feed roller body, to help ensure substantially consistent feeding of the sheet material (e.g., preventing or reducing jamming and/or tearing of the sheet material) as well as increasing the working/useful life of the components of the feed roller.

The feed roller pulley can be disposed, arranged, or located along the feed roller body. In one embodiment, the feed roller pulley can be at least partially received or defined within a circumferential groove or channel defined in an outer surface of the feed roller body. Accordingly, the drive belt may be disposed within the outer, circumferential surface of the feed roller body, or a perimeter defined thereby. As another alternative, the feed roller body can include teeth or other engaging surfaces formed along its body (including at a recessed area) and which are adapted to be engaged by the drive belt. The drive belt further can include a plurality of ribs, notches, teeth or cogs disposed therealong and configured to at least partially contact or engage corresponding notches, indentations, recess, etc. between gear teeth or projections defined along a motor pulley, and along the feed roller pulley or the feed roller body.

The feed roller drive system assembly further can be substantially configured as a unit or module. The drive system with the drive belt transmission assembly also may help provide a reduction in noise in comparison to other transmissions/assemblies, such as assemblies utilizing a series of rigid, intermeshing gears, and/or drive arrangements mounted externally of the dispenser, such as drive arrangements mounted along the side of a dispenser. In addition, in another aspect, the drive belt transmission assembly may have an extended working/useful life in comparison to other components, and may allow for driving of the feed roller, and/or mechanisms/systems attached thereto or in communication therewith, using reduced power.

In one embodiment, the feed roller drive assembly or system, including the drive motor and at least a portion of the drive belt transmission assembly, can be located and/or mounted at least partially within a cavity or chamber defined within the dispenser housing. For example, the drive mechanism can be coupled to a motor housing or support that is connected to one or more interior support portions of the dispenser housing that are positioned within an interior chamber or cavity of the dispenser housing. The mounting of the motor within an interior cavity or chamber of the dispenser housing also can help substantially reduce ambient noise heard/experienced outside the dispenser housing during operation of the dispenser.

According to embodiments of the present disclosure, the drive belt transmission assembly also can include a tensioner assembly for creating and/or maintaining tension in the drive belt. The tensioner assembly can include a tensioner bracket movably mounted within the dispenser housing adjacent or proximate to the drive belt, and a roller configured to engage the drive belt for providing tension therealong. In one embodiment, the tensioner bracket can be biased, such as by a spring or biasing member, so as to press or engage the roller against an upper surface of the drive belt. The biasing force applied to the drive belt can be adjusted but generally will be sufficient to provide a substantially consistent tension along the drive belt to prevent slippage of the drive belt against the motor and/or feed roller pulley(s), and/or to help reduce premature wear of the drive belt.

In another embodiment, the dispenser can include a tensioned motor support assembly that includes a biasing member (e.g., a tension spring or other suitable spring or biasing member) that engages and biases the motor to prevent slippage of the drive belt. For example, at one end the biasing member can be connected to at least a portion of the housing, and at another end thereof can be connected to a support or mounting bracket (e.g., that supports the motor in a cantilever type arrangement) to bias the support/mounting bracket, and the motor supported thereby, in a manner to provide a sufficient tension force or stress along the drive belt (e.g., to prevent slippage thereof).

In additional embodiments, a tensioned motor mounting assembly can include a support frame or support portion and a base or pivot arm. The support frame/support portion is connected to and supports the motor, and further is coupled to the base (e.g., by a plurality of fasteners). The base further is moveably (e.g., slidably, pivotably, rotatably) coupled to the dispenser housing. For example, in one embodiment, the base is connected to the dispenser housing (e.g., an intermediate wall thereof) by a plurality of fasteners that are received within slots or other suitable apertures or openings that allow movement on the fasteners therealong. Alternatively, the base can be connected to the dispenser housing by a bearing assembly or other suitable mechanism that allows for rotation/pivoting of the support assembly thereabout.

The motor support assembly further includes one or more biasing members connected thereto for biasing the motor support assembly, such as to provide tension along the drive belt (e.g., to substantially prevent, reduce, or inhibit wear, slippage, etc. thereof) and/or to provide dampening for the motor/drive assembly (e.g., dampening or absorbing motor vibrations or other components of the drive system). In one example, the biasing member(s) can include a spring(s) with one end thereof connected to the frame and another end thereof connected to a portion of the dispenser housing.

Additionally, the tensioned motor mounting assembly can include a bearing or bushing that is coupled to the base (e.g., is fitted or otherwise received within an opening or aperture thereof) that at least partially supports or engages an end portion of the motor driveshaft. The bearing or bushing further generally is mounted between the base and driveshaft in a manner so as to substantially prevent, reduce, or inhibit bending or twisting of the driveshaft or components of the drive assembly (e.g., the belt gear attached to the driveshaft), and thus help substantially prevent, reduce, or inhibit uneven wear thereof or other damage thereto.

These and other advantages and aspects of the embodiments of the disclosure will become apparent and more readily appreciated from the following detailed description of the embodiments and the claims, taken in conjunction with the accompanying drawings. Moreover, it is to be understood that both the foregoing summary of the disclosure and the following detailed description are exemplary and intended to provide further explanation without limiting the scope of the disclosure as claimed.

BRIEF DESCRIPTION OF THE DRAWINGS

The accompanying drawings, which are included to provide a further understanding of the embodiments of the present disclosure, are incorporated in and constitute a part of this specification, illustrate embodiments of the invention, and together with the detailed description, serve to explain the principles of the embodiments discussed herein. No attempt is made to show structural details of this disclosure in more detail than may be necessary for a fundamental understanding of the exemplary embodiments discussed herein and the various ways in which they may be practiced.

DETAILED DESCRIPTION

Figure 1B:
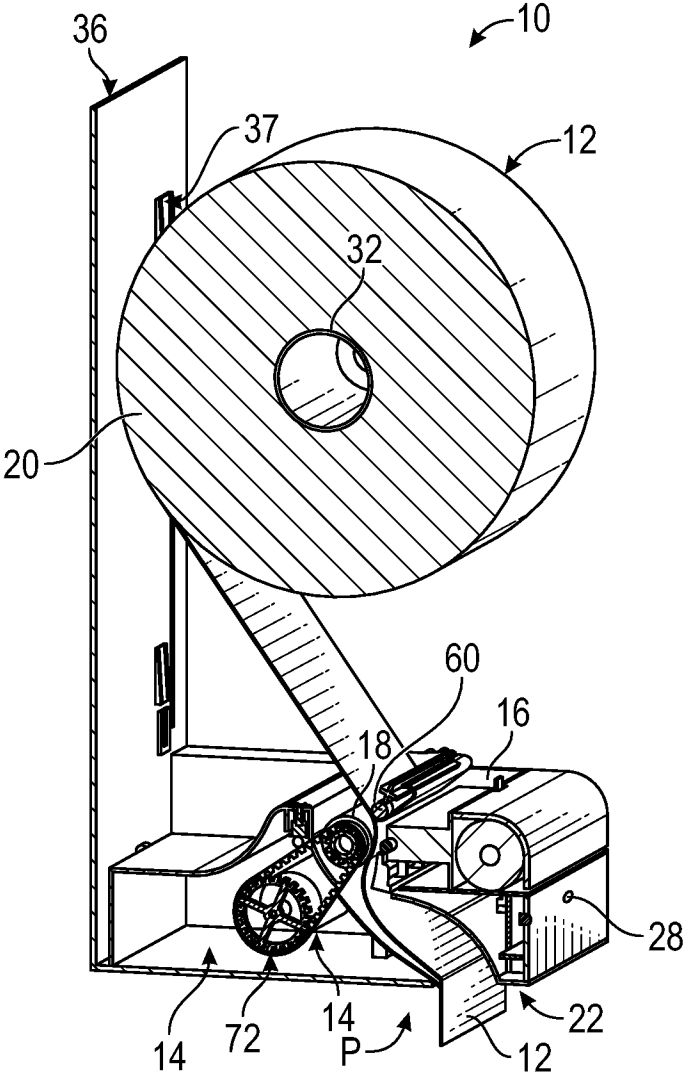
FIGS. 1A-C shows a perspective, partial cutaway views of an example dispenser according to principles of the present disclosure.

The following description is provided as an enabling teaching of embodiments of this disclosure. Those skilled in the relevant art will recognize that many changes can be made to the embodiments described, while still obtaining the beneficial results. It will also be apparent that some of the desired benefits of the embodiments described can be obtained by selecting some of the features of the embodiments without utilizing other features. Accordingly, those who work in the art will recognize that many modifications and adaptations to the embodiments described are possible and may even be desirable in certain circumstances. Thus, the following description is provided as illustrative of the principles of the embodiments of the present disclosure and not in limitation thereof.

As generally illustrated in FIGS. 1A-1C, 2, 3A-3B, 4A-4C, 5, 6A-6B, 7A-7B, 8, 9A-9C, 10A-10C, 11A-11C, 12, 13A-13C, 14A-14C, 15A-15D, 16A-16C, 17A-17B, 18, and 19 the present disclosure is, in one aspect, directed to a dispenser 10 and components thereof for feeding or dispensing a flexible sheet material 12. Such sheet material can include, in some aspects, paper sheet materials such as towels, tissue, napkins, etc. In other aspects, the sheet material can include other types of sheet materials including plastic or other materials. The dispenser 10 generally will include a motorized or driven feed roll drive assembly/system 14 mounted/disposed within a dispenser housing 16 and operable to substantially automatically dispense a length of sheet material (FIGS. 1A-1C, 2, 3A-3B, 4A-4C, 5, and 6A-6B). For example, a predetermined length or size sheet (e.g., a 10"-12" or other desired length) can be dispensed. Upon activating the dispenser 10, the feed roller drive assembly 14 is engaged and operates to drive or cause rotation of a feed roller or drive spindle 18. The rotation of the feed roller 18 in turn pulls the sheet material from a supply 20 for feeding of the measured or selected amount or length L of sheet material 12 along a conveying or feed path P (FIGS. 1B and 3A-3B) from the roll or supply 20 of the sheet material 12 through the dispenser and out of a discharge 22, such as a discharge chute or other suitable aperture or opening, provided/defined in the housing 16 of the dispenser, as generally indicated in FIGS. 1B-1C and 3A-3B.

The driven feed roller drive assembly 14 can be activated to feed or drive the sheet material 12 from the supply 20 of sheet material to and through the discharge 22 of the dispenser housing 16, for example, upon receiving a signal from a control system 24 of the dispenser. An example of a control system 24 for a dispenser is shown generally in FIG. 19, and can include a controller or processor 210 including control software/programming for controlling the feed roller drive assembly to feed the selected or desired length of sheet material, and to monitor the dispenser and components such as the supply of sheet material and usage/operation of the dispenser. The controller further will be in communication with, and will receive a plurality of signals, from a sensor or an array or series of sensors, such as generally indicated at 28, to control dispensing of the sheet material 12.

The sensors 28 can include various type sensors or detectors, for example, including an adjustable proximity sensor that can be configured/adjusted to detect the presence of a user's hand or other object at a desired range/location and dispense measured/selected amounts of sheet material 12, or one or more pairs of IR sensors (e.g., an emitter and a corresponding detector) that are arranged about/within the discharge chute and transmit/receive signals across the discharge path to sense or detect the presence or absence of sheet material or other object within the discharge chute or otherwise along the feed path. Any suitable sensor, however, such as a photoelectric, light curtain, or other similar sensing systems/detectors, can be used to detect the presence of a user's hands or other object placed along the dispenser housing, and/or the feeding of a selected amount of sheet material 12 can be used, without departing from the present disclosure. In addition, various sensor arrays and/or control systems can be used, such as disclosed in U.S. patent application Ser. No. 15/185,937, and Ser. No. 14/256,019, the complete disclosures of which are incorporated by reference as if set forth fully herein.

It further should be appreciated that the dispenser described herein should not be considered to be limited to any particular style, configuration, or intended use or type of sheet material. For example, the dispenser may be operable to dispense paper towels, toilet tissue, or other similar paper or sheet materials, including dispensing or feeding non-perforated and/or perforated sheet materials.

Figure 1A:
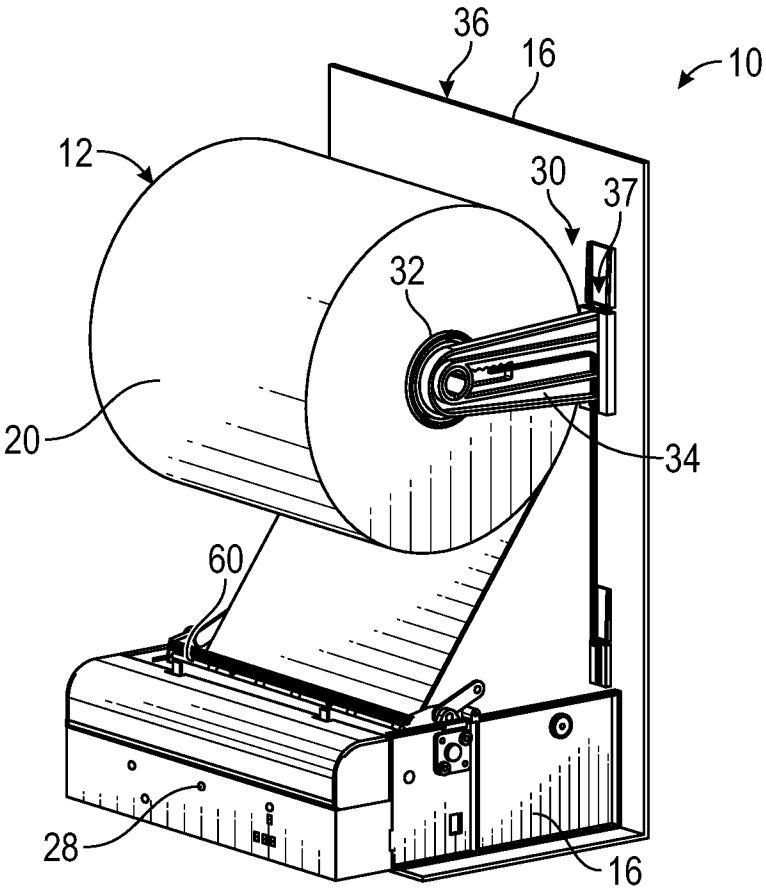
Figure 1C:
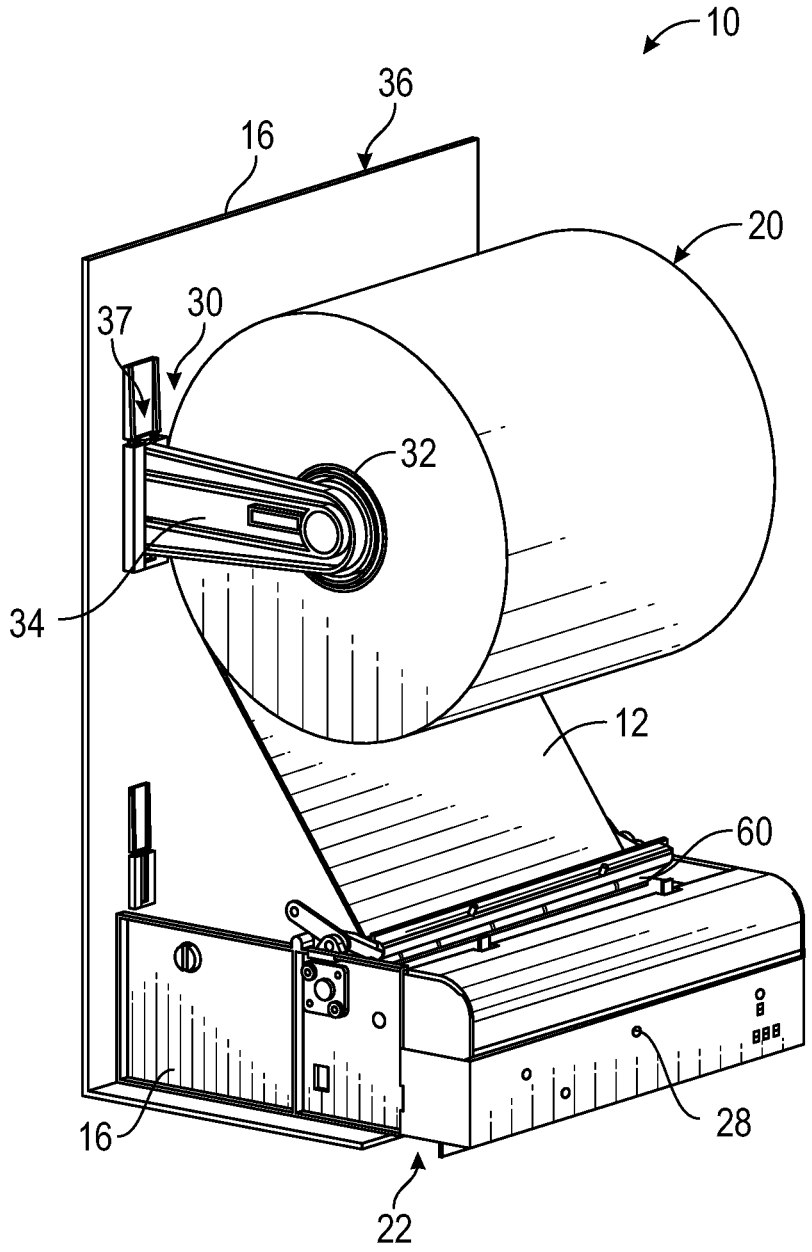
Figure 2:
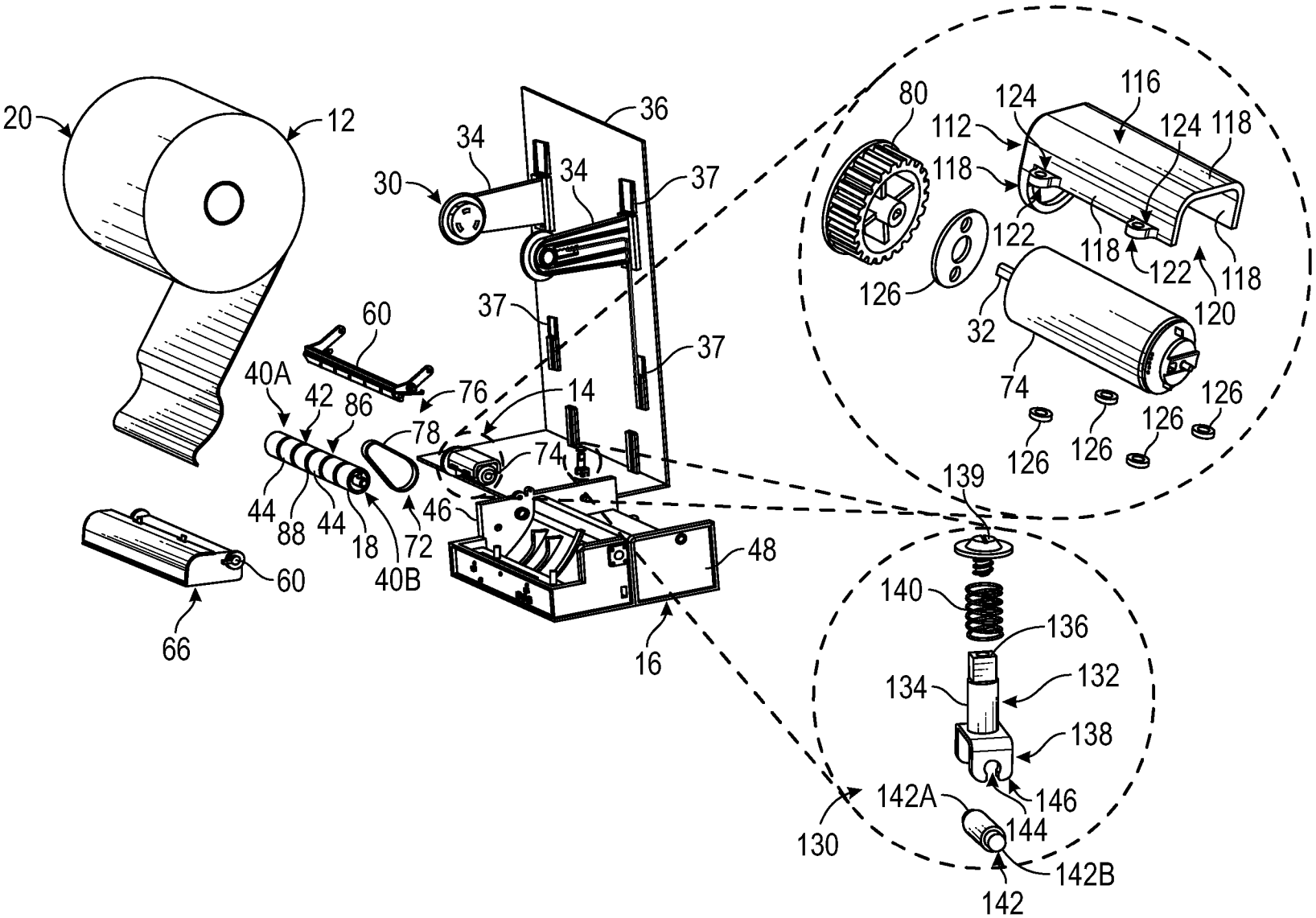
FIG. 2 shows an exploded view of the various components of the dispenser according to principles of this disclosure.

As indicated in FIGS. 1A, 1C, and 2, the dispenser housing 16 generally will include a roll support mechanism/assembly 30, for holding at least one roll 32 of the supply 20 of sheet material 12. As shown in FIGS. 1A and 1C, the roll 32 can be supported by a pair of supports or arms 34 coupled to the dispenser housing 16. These arms/supports 34 may be fixedly arranged to hold the supply 20 of sheet material in a spaced relationship with respect to the feed roller 18. For example, the support arms 34 can be attached or coupled to the housing by sliding or snap-fitting at least a portion of the supports/arms within grooves or slots 37 defined along a rear portion 36 of the dispenser housing. However, the support arms 34 can be connected to the dispenser housing 16 in any suitable manner, such as with one or more fasteners or other suitable connection mechanisms. As a further alternative, the support arms also can be integrally formed with the housing without departing from the present disclosure. Additionally, the support arms 34 may be biased or urged, such as by a spring or other suitable biasing mechanism(s), or by a general resiliency, toward the feed roller 18 to urge or direct the supply 20 of sheet material downwardly toward or against the feed roller 18.

FIGS. 2 and 4A-4C illustrate an example driven feed roller 18 of the feed roller drive assembly 14. As indicated in FIGS. 2 and 4A-4C, the feed roller 18 generally will include an elongated body 40. The body 40 can be made of a molded plastic, synthetic or other composite material, though other types of low or reduced static materials. In one aspect, a wood material can be used. In another aspect, metal materials, which can include an insulating material applied thereabout, also can be employed. The feed roller body 40 will include first and second ends 40A/40B and a generally cylindrical outer side wall 42.

Figure 4A:
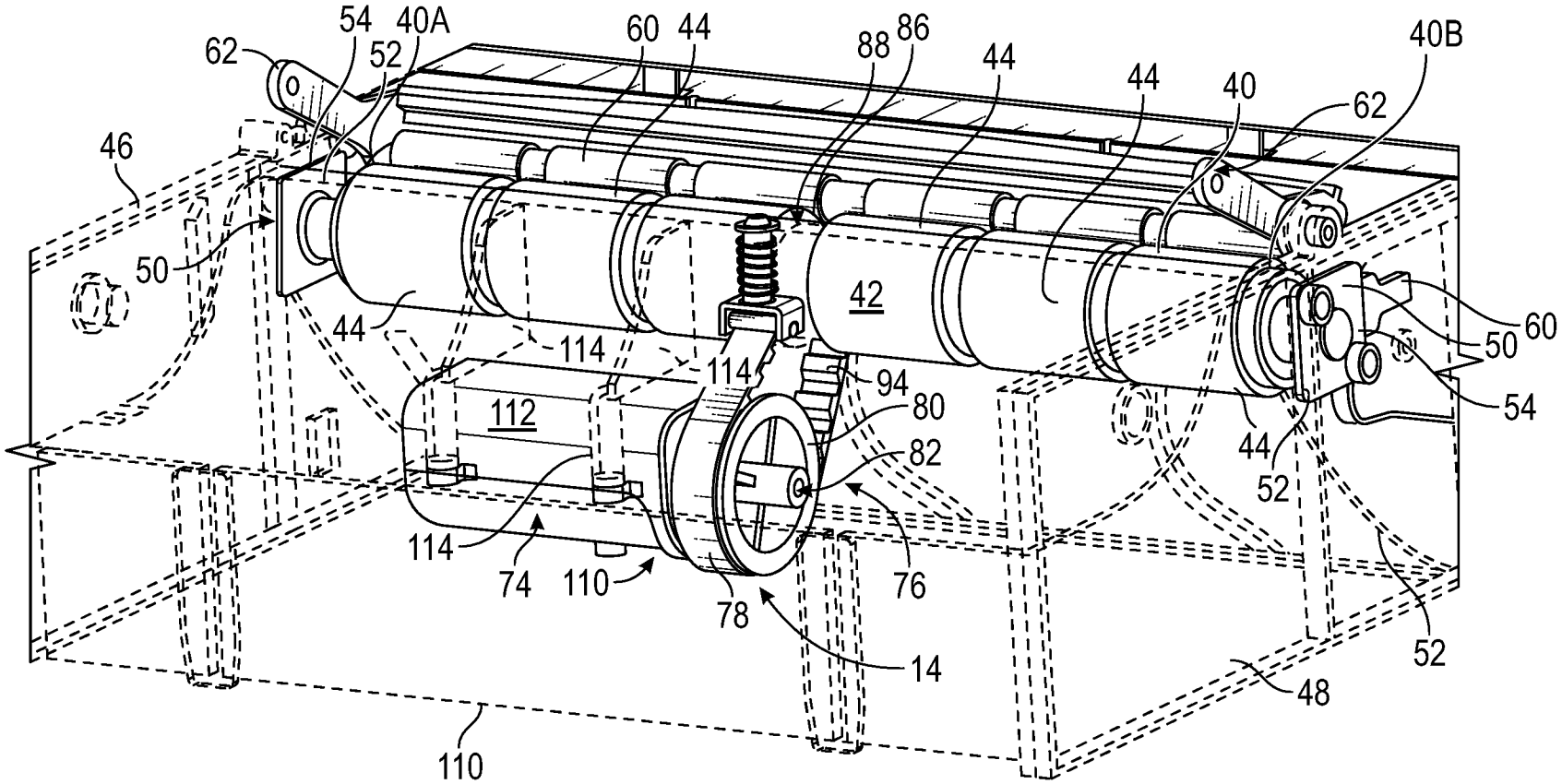
FIGS. 4A-C illustrate the belt drive transmission assembly of the feed roller drive assembly/system of FIGS. 2-3B.
Figure 4B:
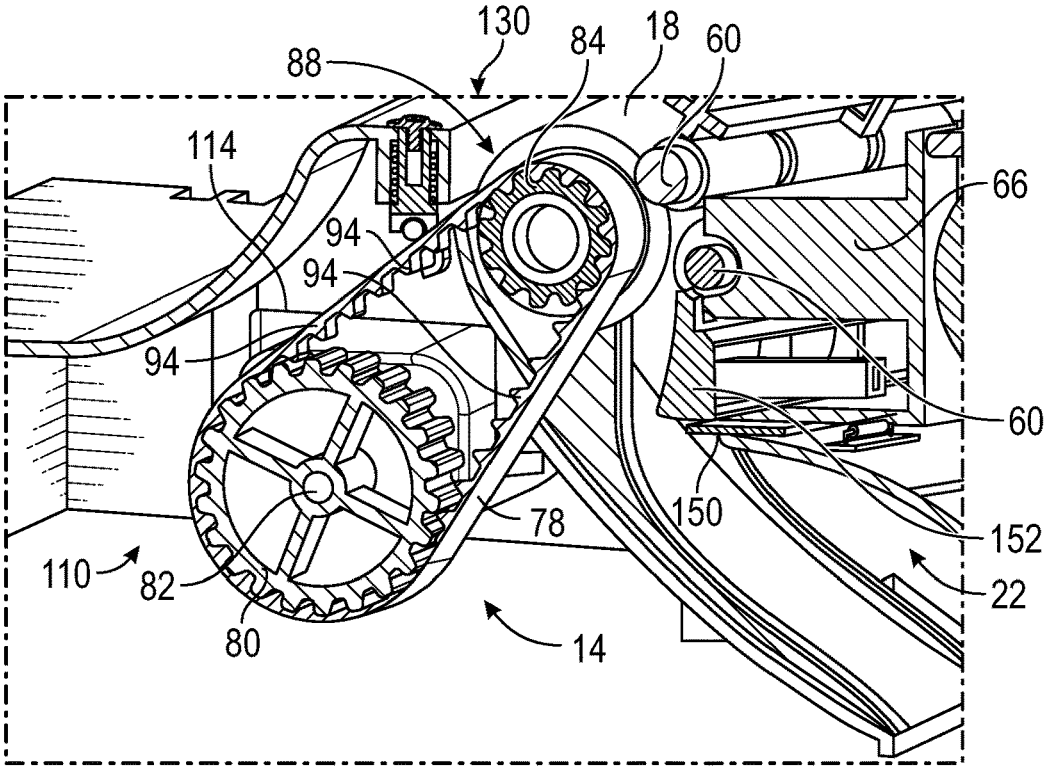
Figure 4C:
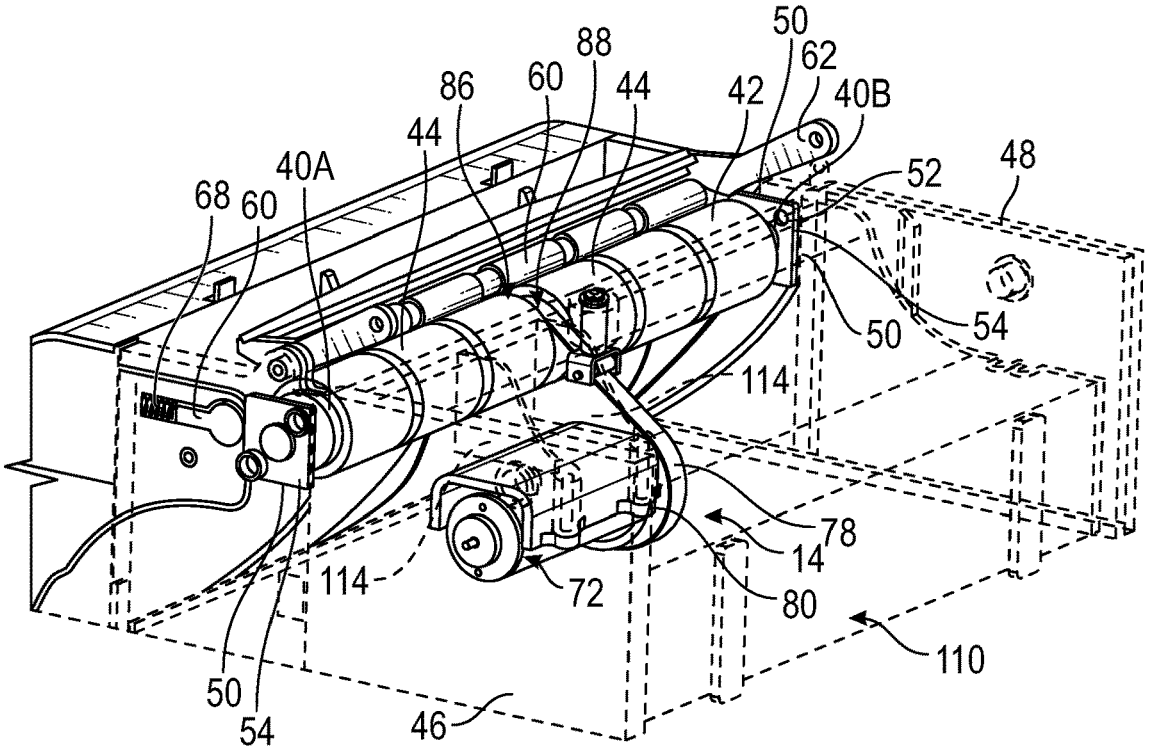
Figure 5:
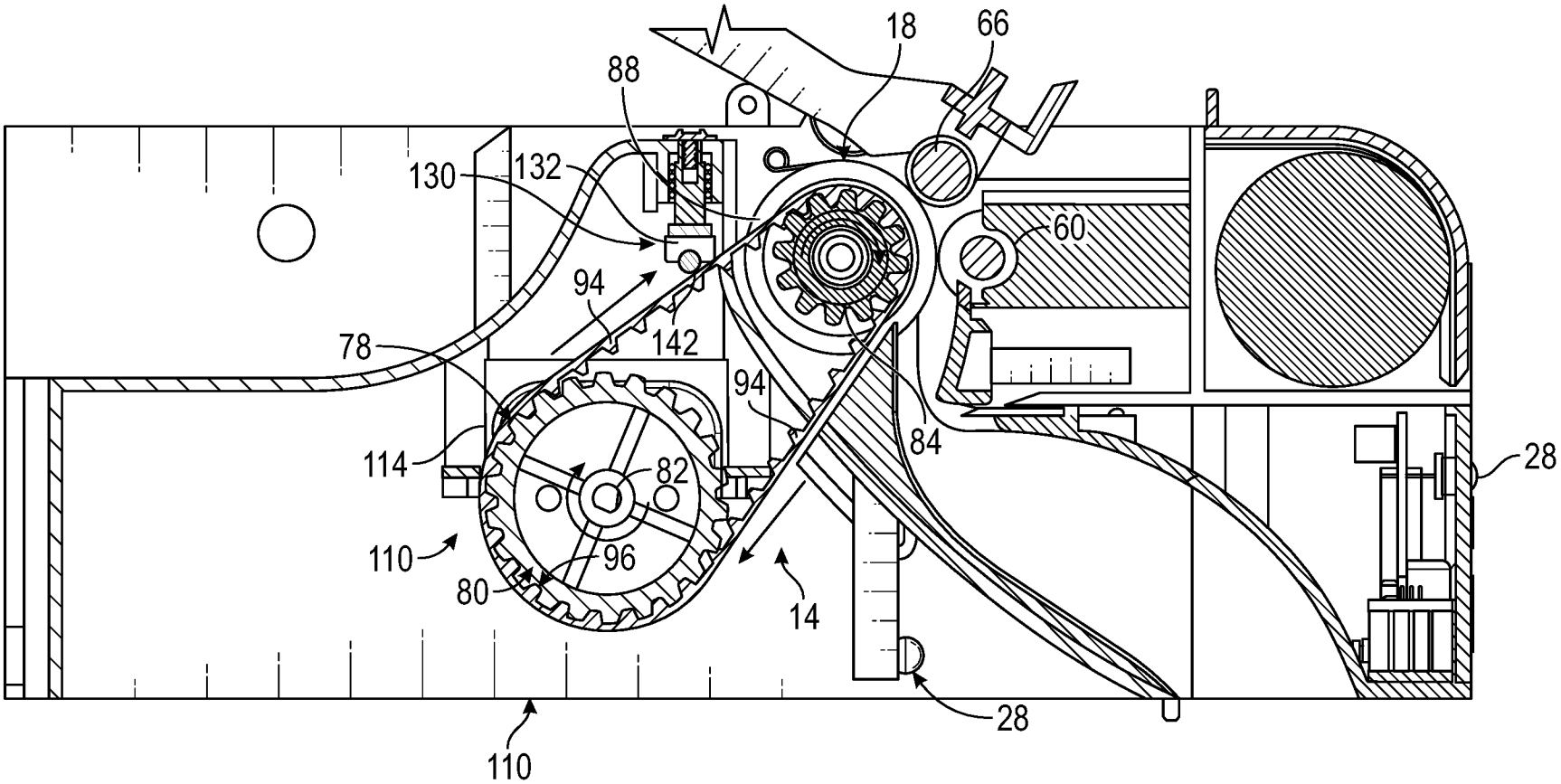
FIG. 5 is a cross-sectional view of the dispenser, substantially illustrating operation of the feed roller drive assembly/system of FIGS. 3A-B and 4A-C.

In some embodiments, the feed roller body 40 also may include one or more driving bands or sections 44 disposed on an outer surface 42A of the side wall 42, such as a series of driving bands being disposed on the outer surface in a spaced arrangement or configuration. The driving bands 44 may at least partially include or be comprised of rubber, plastic, resin or other, similar materials suitable to increase grip of the feed roller 18 and/or friction between the feed roller 18 and the sheet material 12 to thereby assist in the feeding or driving of the sheet material 12. It further will be understood that although some exemplary embodiments, such as illustrated in FIGS. 4A and 4C, show six substantially equally sized driving bands 44 disposed in a spaced relationship about the outer surface of the feed roller body, any number, size, arrangement and/or configuration of driving bands also may be used in accordance with embodiments of the present disclosure. Still further, the feed roller 18 can be provided without driving bands, or, as another alternative, can have a covering or sleeve of a grip increasing material.

As further shown in FIGS. 2, 4A, and 4C, the feed roller body 40 can be movably or rotatably coupled to one or more walls or other portions of the dispenser housing 16, such as side walls 46/48. The first 40A and/or second 40B ends of the feed roller body can be connected, mounted, or otherwise coupled to the side walls 46/48 by one or more bearing assemblies 50. Other suitable support mechanisms that support and allow for rotation of the feed roller body in relation to the dispenser housing 16 further can be used. The bearing assemblies 50 may include roller or ball bearings that can be contained, housed or otherwise disposed between bands or rings defining a bearing body 52. In one aspect, the bearing body 52 can include a base or platform 54 that is coupled or fixed to a side wall 46/48 of the dispenser housing, for example, using one or more fasteners (e.g., screws, bolts, rivets, etc.). The bearing assemblies also can be otherwise fixed or integrally formed with one or more portions/components of the dispenser housing. Embodiments of this disclosure additionally are not limited solely to the use of roller/ball bearings, and may include other types of bearings, such as plain, fluid, or magnetic bearings or any other suitable mechanisms for rotatably fixing the feed roller body to or otherwise within the dispenser housing.

As illustrated in FIGS. 2, 3A-3B, 4A-4C, and 5, the dispenser assembly 10 further generally can include one or more pressing rollers 60. The pressing rollers 60 can be biased toward engagement with the feed roller 18, so as to engage and urge or press the sheet material 12 against the feed roller 18, e.g., with a force sufficient to facilitate drawing or pulling of the sheet material therebetween upon rotation of the feed roller. The pressing roller(s) 60 can be mounted within the dispenser housing 16, such as with the ends thereof held within one or more arms or supports of a bracket 62 in a manner to enable rotation of the pressing rollers. The bracket 62 also can be biased by a biasing member, such as a spring or other suitable biasing member, so that the pressing rollers 60 can be urged toward the driven feed roller 18.

One or more pressing roller(s) 60 further can be disposed within a frame or other structure 66 and biased toward the feed roller such as by compressing spring 68 or other suitable springs, biased cylinders or other biasing mechanisms (FIG. 2, 3A-3B, 4C). In one embodiment, the frame 66 can support at least two pressing rollers and also can be pivotable to enable one pressing roller to move away from the feed roller as needed, while the other roller is pivoted into closer contact with the feed roller (not shown).

The pressing roller(s) additionally can include bands of a gripping material, such as a rubber or synthetic material, to assist in pulling the sheet material therebetween without causing damage to the sheet material as it passes between the feed roller and pressing roller(s). The engagement of the pressing rollers 60 and feed roller 18 will define nip points at upstream and downstream points along the feed path P of the sheet material 12 as the sheet material 12 is engaged and fed between the feed roller 18 and the pressing rollers. In addition, or alternatively, the pressing rollers 60 may be driven by drive mechanism, for example, off of a motor 74 that drives the feed roller or by a separate drive, so as to facilitate feeding of the sheet material 12.

FIGS. 2, 3A-B, 4A-3, 5, and 6A-B show the feed roller drive assembly 14 for driving rotation of the feed roller 18 to dispense selected amounts of sheet material. The feed roller drive system/assembly 14 can include at least one driving mechanism, e.g., a motor 74, that is in communication with the feed roller so as to drive movement/rotation thereof. The motor 74 can include a brushless servo or stepper motor or other, similar type of variable speed electric motor, and communicates with the control system of the dispenser 10 to receive instructions and power for activating and driving the feed roller 18 through a dispensing cycle (e.g., a determined time, number of revolutions, etc.), so as to feed the selected or desired amount/length of the sheet material through the discharge opening of the dispenser.

In one additional aspect, the drive system/assembly 14 also can include a drive belt transmission assembly 76 for transferring power between the drive motor 74 and the feed roller 18. The drive belt transmission assembly 76 can include a drive belt 78 coupling the drive motor 74 to the feed roller 18. In one example, the drive belt 78 can engage a pulley, sheave, or belt gear 80 attached or otherwise operably connected to a driveshaft 82 of the motor 74. The drive belt 78 further can be coupled to the feed roller 18, such as by engaging a pulley, sheave, or belt gear 84 that is operatively connected to the feed roller 18, or by otherwise engaging the feed roller body 40. The pulleys 80 and 84 also can be configured with differing gear ratios to provide a desired driving force to the feed roller. By way of example, a gear ratio of about 11/6 or about 1.833 can be used in some embodiments. However, it will be understood that any suitable gear ratio, such as about 2/1, about 3/1, etc., can be used without departing from the scope of present disclosure.

In one embodiment, the feed roller pulley 84 can be attached or connected to the feed roller body 40 at a position between its ends 40A, 40B. For example, the feed roller pulley 84 may be mounted or located between the ends 40A, 40B at a position that is substantially spaced apart from both of the ends 40A, 40B. In one aspect of the present disclosure, the feed roller pulley 84 can be arranged/positioned approximately intermediate or substantially at a midpoint 86 of the feed roller body 40. Such arrangement/positioning may facilitate the application of a substantially consistent driving force along the feed roller body, which may provide consistent feeding of the sheet material (e.g., preventing or reducing jams, tears, etc.) as well as increasing the working life of the components of the feed roller.

As shown in one embodiment, the feed roller pulley 84 can be disposed at least partially within a circumferential groove 88 defined in the outer circumferential surface 42A of the feed roller body 40. Accordingly, at least a portion of the drive belt 78 may be disposed within the circumferential groove 88 and at a position that is substantially below or otherwise within a perimeter or outer boundary defined by the outer surface 42A of the feed roller body. For example, as generally illustrated in FIG. 6B, a portion 90 of the drive belt 78 that is at least partially in engagement with the feed roller pulley 84 may be positioned within the groove 88 and spaced away from a portion 92 of the feed roller body 40 that contacts or engages the sheet material driving disposing thereof, to help to prevent the drive belt 78 from interfering with dispensing of the sheet material.

The feed roller pulley 84 also can be integrally formed with the feed roller body 40, though other constructions are possible, without departing from the present disclosure. For example, the feed roller pulley can be a separate part/component that is coupled between two separate, symmetrical parts that can be connected/coupled together to form the feed roller body. As a further alternative, the drive belt can engage or be fitted in a driving relationship with the feed roller directly without a drive pulley or gear.

The drive belt 78 can include a synchronous belt with a plurality of ribs, notches, or cogs 94 disposed therealong that are configured to be at least partially received within corresponding notches or teeth 96/98 of the motor pulley and the feed roller pulley. Other types and/or configurations of drive belts also can be used. The drive belt assembly according to embodiments of the present disclosure may substantially reduce noise in comparison to other drive transmissions/assemblies, such as drive assemblies utilizing a series of intermeshing gears. Further, the drive belt assembly according to embodiments of the present disclosure may have an extended working life in comparison to other systems/assemblies, and may allow for driving of the feed roller, or mechanisms/systems attached thereto or otherwise in communication therewith, using reduced power requirement in comparison to other driving systems/assemblies.

In one embodiment, the drive belt 78 can be a type 72XL belt, having a belt width of about 10 mm and having about 32 to about 36 cogs. It will be understood, however, that the drive belt can have any suitable width, e.g., about 5 mm to about 10 mm, and/or suitable number of teeth or cogs, e.g., about 20 to about 60 cogs, without departing from the scope of the present disclosure. The belt and/or the cogs thereof can comprise a chloroprene rubber adhesive or other suitable elastic material, though any material can be used without departing from the scope of the present disclosure. The pitch of the cogs further can be about 4 mm to about 8 mm, and in another aspect, about 5.0 to about 6.0 mm and can have a height of about 1 to about 3 mm, and in one aspect about 1.25 mm to about 1.27 mm.

The drive belt 78 further can comprise one or more layers or plies, including a tensile layer that comprises a reinforcement, for example, fiberglass, though the belt can comprise any suitable material, e.g., other rubbers, plastics and/or composites, without departing from the present disclosure. Additionally, the drive belt 78 can include a wrapping, such as a cloth or sheet material comprising high elastic nylon, though the wrap cloth can comprise any other suitable material without departing from the present disclosure. Further, the drive belt 78 can have a thickness of about 2.0 mm to about 2.30 mm, though the belt can have any suitable thickness, e.g., about 1.5 mm to about 3.00 mm, or greater than 3.0 mm, and a tensile strength of about 60 N/mm to about 80 N/mm with an elongation of the belt generally being less than about 6%-4%. Still further, the drive belt 78 can have a hardness of about 75, though the belt may have any suitable hardness, while retaining sufficient flexibility, for example, about 65 to about 70 or about 80 to about 85, though belts with hardness values less than 65 or greater than 85 also can be used without departing from the scope of the present disclosure.

In addition, as shown in FIGS. 3A-B, 4A-B, and 5, with embodiments of the present disclosure, the drive motor 74 and other components of the drive assembly 14 can be located internally within the housing of the dispenser. In one example embodiment, the motor 74 can be mounted at least partially within a cavity or chamber 110 defined within the dispenser housing. The motor 74 also can be provided as part of a drive unit, with the motor 74 coupled to a motor housing 112 that is fixed or coupled to one or more support portions 114 of the dispenser housing within the interior chamber or cavity 110 of the dispenser housing. The motor housing 112 may have a body 116 with a series of walls or sides 118 arranged to at least partially form a channel or groove 120 sized and/or configured for receiving at least a portion of the motor 74 therealong (FIG. 2). The walls 118 further may have projection portions 122 with holes or apertures 124 defined therethrough for receipt of one or more fasteners (e.g., screws, bolts, rivets, etc.) to fix/couple the motor housing to the supports 114 (FIG. 2).

With the drive motor 74 received within the channel 120 of the motor housing 112, the driveshaft 82 of the motor 78 may extend through an opening or aperture in a wall 118 of the motor housing 112. Additionally, one or more dampening pads, such as silicon pads 126, further may be provided, such as, at the connection of the motor housing to the supports and between the motor and the motor housing, to reduce vibration and/or noise due to operation of the motor. The internal mounting assembly of the motor within the cavity or chamber of the dispenser housing can isolate the motor so as to substantially reduce ambient noise heard/experienced outside the dispenser housing during operation of the drive mechanism.

Figure 6A:
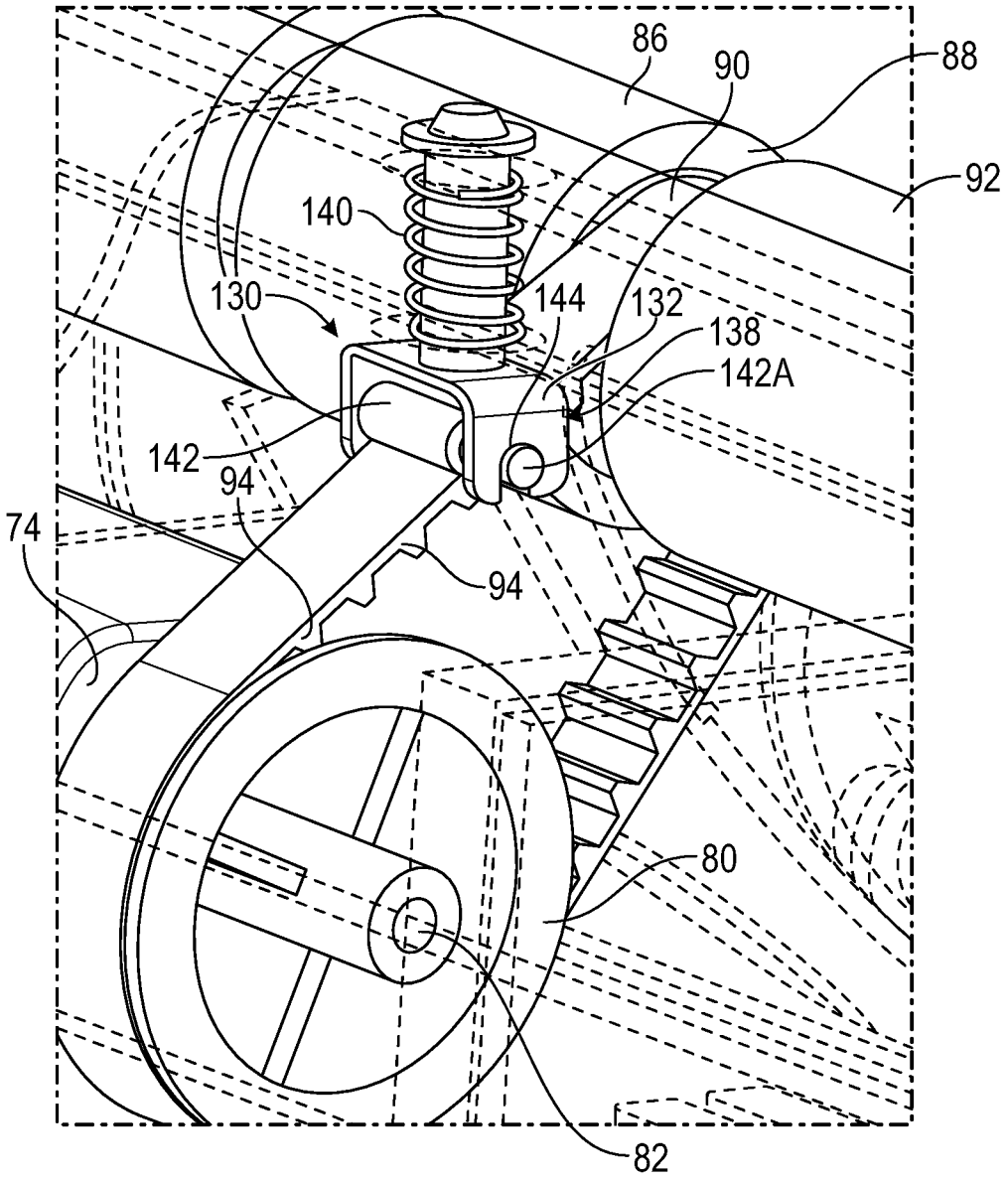
FIGS. 6A and 6B illustrate example arrangements of the drive belt transmission assembly/system and tensioner assembly engaging the drive belt according to one aspect of this disclosure.
Figure 6B:
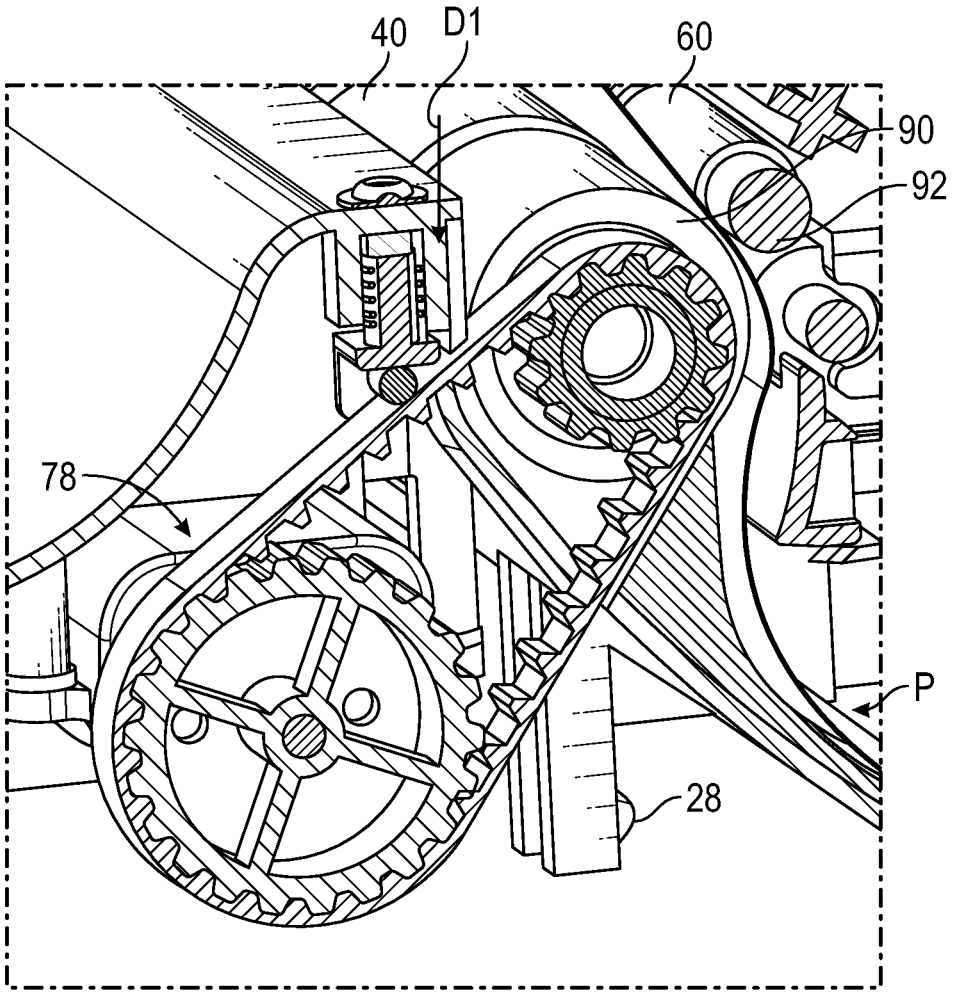

As generally shown in FIGS. 2 and 6A-B, the drive belt transmission assembly 76 further can include a tensioner assembly 130 for tensioning the drive belt 78. The tensioner assembly 130 can include a tensioner bracket 132 having a body 134 with a first, upper end 136 and second, lower end 138 (FIG. 2). The tensioner bracket 132 can be mounted within the dispenser housing, e.g., by a fastener 139, and generally will be located or arranged along and substantially adjacent or proximate to the drive belt 78 as generally shown in FIGS. 6A-B.

The tensioner bracket 132 further can be biased, such as by a spring 140 or other suitable biasing member, sufficient to bias or engage a roller 142 connected to the lower end 138 of the tensioner housing against an upper surface of the drive belt (FIGS. 6A-B). Such a biasing action creates an engagement between the roller 142 and the drive belt 78 that can be selected and/or adjusted as needed to provide a substantially consistent tension along the drive belt 78 to prevent slippage and/or premature wear thereof.

The roller 142 also can be rotatably mounted to the tensioner bracket 132 so as to roll along the moving drive belt 78. For example, one or more ends 142A/B of the roller 142 can be snap-fitted within one or more channels/notches 144 defined in the projecting portion 146 at the lower end 138 of the tensioner bracket 132. Due to the applied biasing or spring force, the tensioner assembly 130 generally will urge the roller in a downward direction D1 and toward engagement with the drive belt 78 sufficient to tension or tighten the belt. The spring/tension force further can vary with movement of the feed roller/belt, to ensure the belt and the pulleys remain tightly engaged.

Figure 7A:
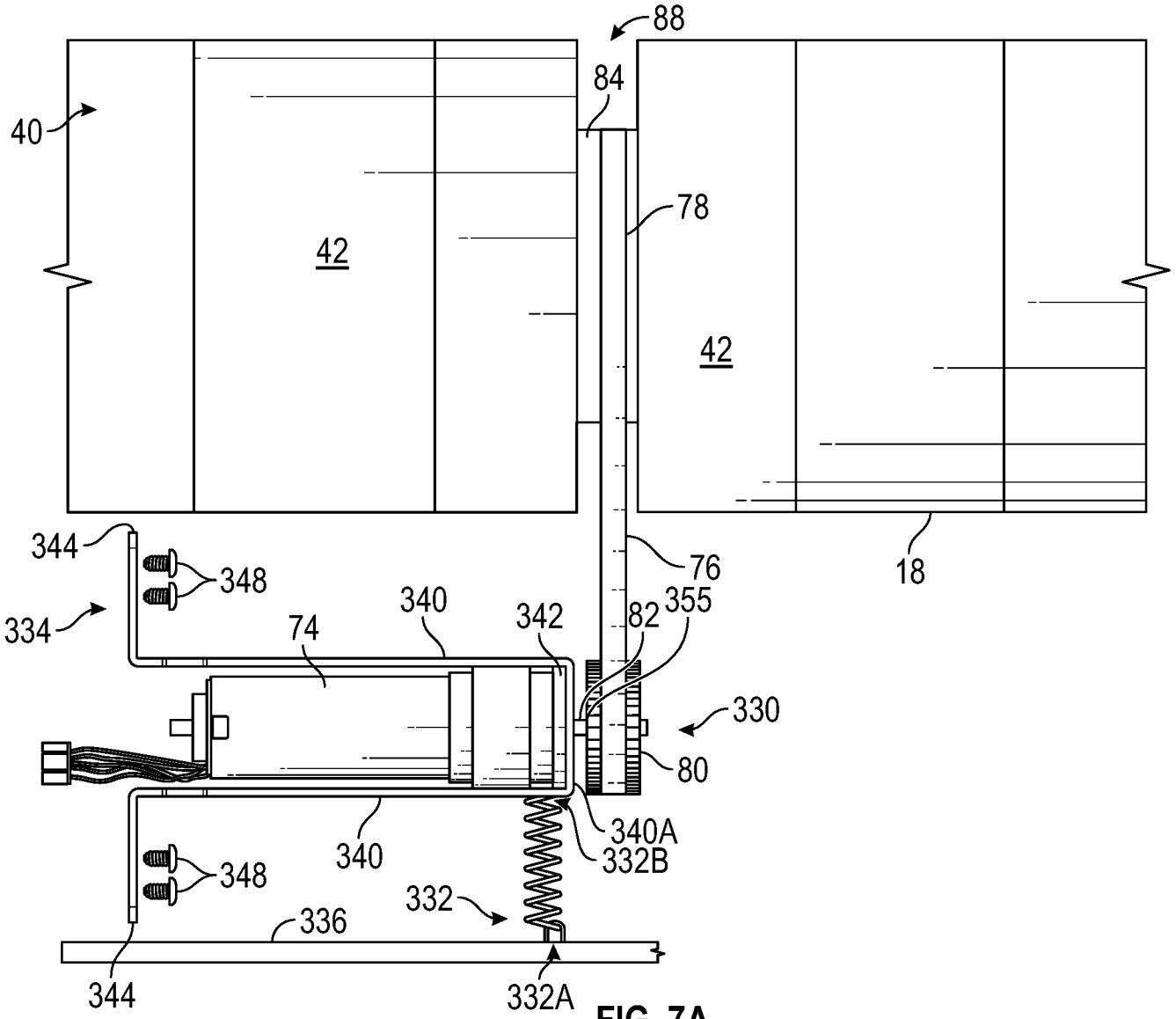
FIG. 7A is a plan view illustrating a tensioner assembly according to one aspect of the present disclosure.
Figure 7B:
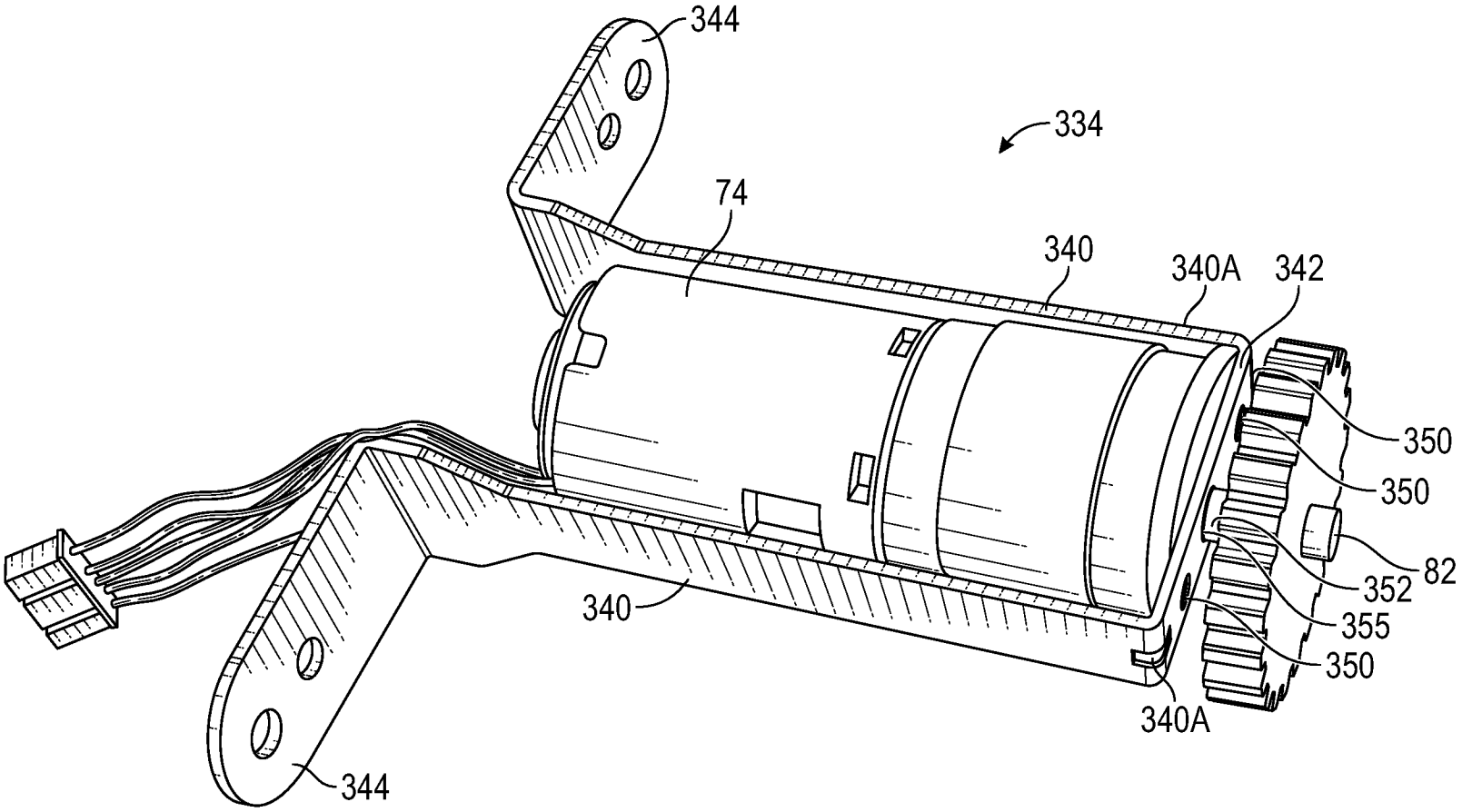
FIG. 7B is a perspective view of a mounting bracket for a motor according to one aspect of the present disclosure.

FIGS. 7A and 7B show a tensioned motor mounting assembly 330 according to one embodiment of the present disclosure. As shown in FIG. 7A, the mounting assembly 330 includes one or more biasing members 332 (e.g., one or more a tension springs or other suitable springs or biasing members) that engage and bias the drive motor 74 to provide a sufficient tension force or stress along the drive belt 78, for example, to prevent slippage and/or premature wear thereof during repeated dispensing operations.

In one example, the mounting assembly 330 includes a mounting bracket 334 supporting the motor 74. The biasing member 332 can be coupled to the mounting bracket 334, such that the biasing member 332 engages/biases the motor 74 and tensions the drive belt 78. As shown in FIGS. 7A-7B, a first end 332A of the biasing member 332 can be connected to a portion 336 (e.g., an interior wall or other suitable portion) of the dispenser housing 16 or to a support member connected thereto, and the second opposing end 332B of the biasing member 332 can be connected to the mounting bracket 334.

The mounting bracket 334 includes a generally u-shaped bracket having side portions 340 and an end portion 342 that is disposed at an end 340A of the side portions 340 (see FIGS. 7A and 7B). The side portions 340 further can include flanges 344, which flanges 344 can be connected to at least a portion of (such as an internal or intermediate wall or another portion connected to) the dispenser housing 16, for example, by fasteners 348, such as screws, rivets, bolt or other suitable fastening mechanisms. The motor 74 can be at least partially disposed between the side portions 340 of the bracket, and can be substantially fixedly connected to the end portion 342, for example, by one or more fasteners 350 (e.g., screws, bolts, etc.). The end portion 342 also includes a hole or aperture 352 that at least partially accepts and receives the driveshaft of the motor 74. Accordingly, the motor 74 can be supported so as to be substantially parallel with the feed roller body 40 in a cantilever-type arrangement that allows for movement of the motor 74 under the tension of the biasing member 332.

The biasing member 332 is connected to an end 340A of one of the side portions 340 of the mounting bracket 334 to bias the motor 74 and the mounting bracket 334 a sufficient amount to provide a tension force or stress along the drive belt 78. The mounting bracket 334 can be made from a metal (e.g., steel, such as plated steel, stainless steel, etc.; aluminum; or other suitable metallic material), a plastic or polymeric material, or other composites/synthetic materials, and generally can be configured so as to allow for some deflection, elongation, or bending of the mounting bracket 334 under biasing of the biasing member 332.

Additionally, or in an alternative construction, the intermediate wall 346 can have slots or other suitably shaped or configured apertures defined therein that received the fasteners 348, or the mounting bracket 334 can be otherwise movably coupled to the dispenser housing, e.g., such as by a bearing or bushing, to allow for some movement of the mounting bracket 334 along the wall 346, e.g., as urged by or under control of the biasing member.

The biasing force applied to the by the biasing member 332 generally will be sufficient to provide a substantially consistent tension along the drive belt 78 to prevent slippage thereof against the motor pulley 80 and/or feed roller pulley 84, and/or to help reduce premature wear of the drive belt 78. Further, the movable mounting bracket 334 will be able to move under the control of the biasing member 332 to substantially dampen or absorb vibrations or other movements by the motor or other components of the drive system to substantially reduce noise generated thereby.

FIGS. 8-11C show a tensioned support assembly 400 for supporting the motor 74 according to an additional aspect of the present disclosure. As generally shown in FIGS. 8-11C, the support assembly 400 includes a support frame 402 that is connected to and supports the motor 74, and a base 404 or other suitable portion that is connected to and supports the support frame 402. The base 404 also movably couples the support frame 402, and the motor 74 supported thereby, to the dispenser housing 16.

The support assembly 400 also can include a biasing assembly 406 (FIGS. 10A-10C) that biases or urges the assembly 400 to provide tensioning along the drive belt 78 (e.g., to substantially prevent, reduce, or inhibit slippage, premature wear, etc. thereof) and also to provide dampening for the dispenser during operation thereof (e.g., to dampen or absorb vibrations of the motor 74, or other components of the drive assembly, such as to reduce noise generated thereby).

FIGS. 8-11C further show that the support frame 402 includes a body 410 with a plurality of supports or arms 412 extending therefrom. The body 410 can be formed from a metal, such as steel, aluminum, etc., though other materials can be used (e.g., other suitable metallic materials, composite materials, polymeric materials, or combinations thereof). The body 410 further includes a surface or face 410A with a plurality of holes 414 defined therein for receiving fasteners, such as screws, bolts, rivets, etc. (not shown), to connect the motor 74 to the support frame 402. The surface/face 410A further will include a hole or aperture 416 defined therethrough and will be sized, shaped, positioned, or otherwise configured for receiving the driveshaft 82 of the motor 74, as generally shown in FIGS. 8 and 9A-9C.

A body or pad, e.g., formed form silicon, rubber, or another suitable material (not shown), can be received about the driveshaft 82 of the motor 74 between the surface/face 410A and the motor 74 in a sandwich type arrangement, e.g., to dampen or absorb vibrations between the motor 74 and the support frame 402. Each support 412 also generally includes a flange 418 or other suitable portion extending therefrom to facilitate attachment of the frame 402 to the base 404. For example, each flange 418 includes a hole or aperture 419 (FIGS. 8 and 9C) defined therethrough for receiving fasteners 400 (such as screws, bolts, etc.), which fasteners 420 can be tightened against/threaded into corresponding threaded holes 422 defined in the base 402 for fixedly attaching the support frame 402 and the base 404.

Figure 8:
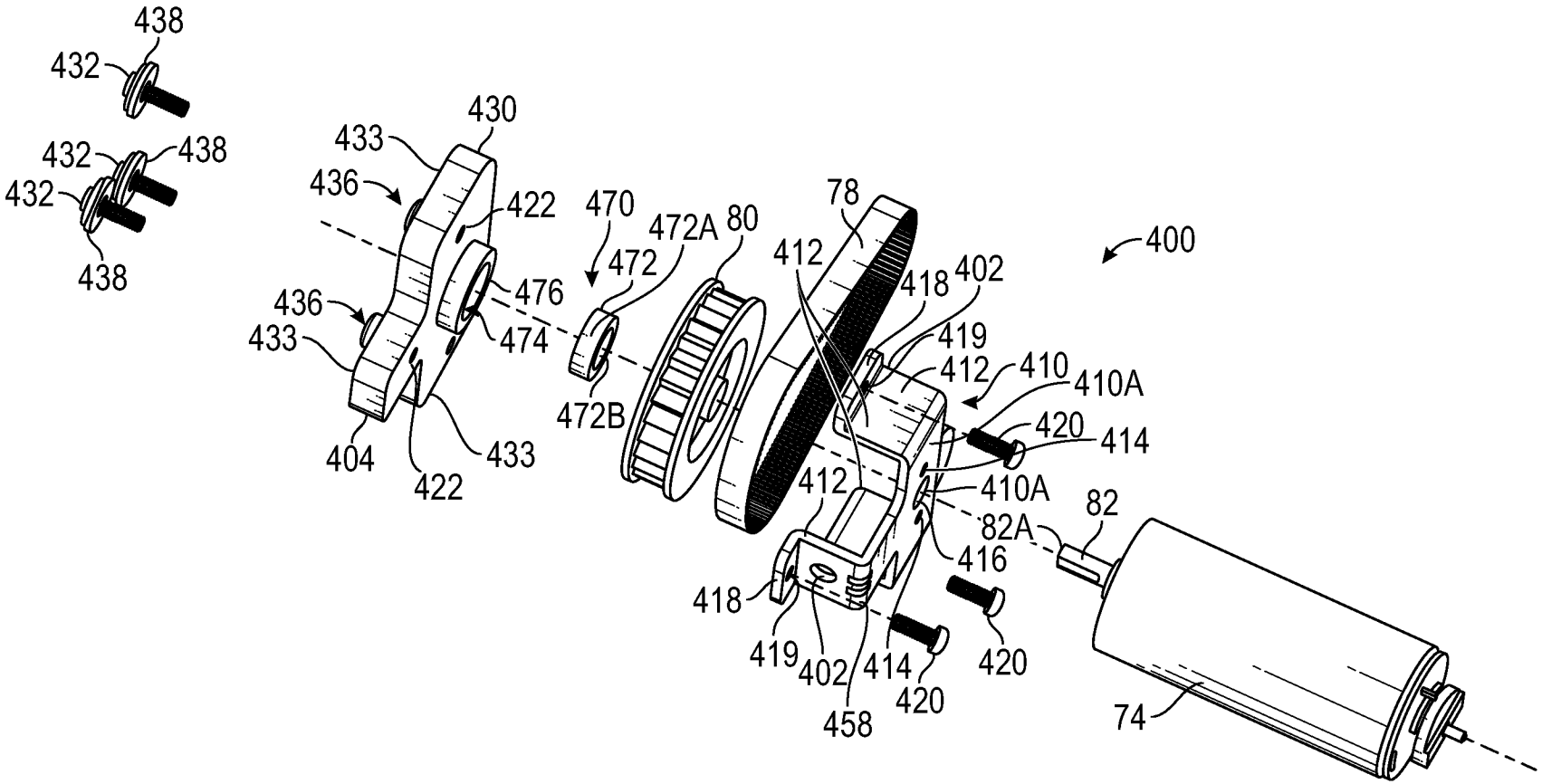
FIG. 8 is an exploded view of a tensioned motor support assembly for the drive motor according to one aspect of the present disclosure.
Figure 9A:
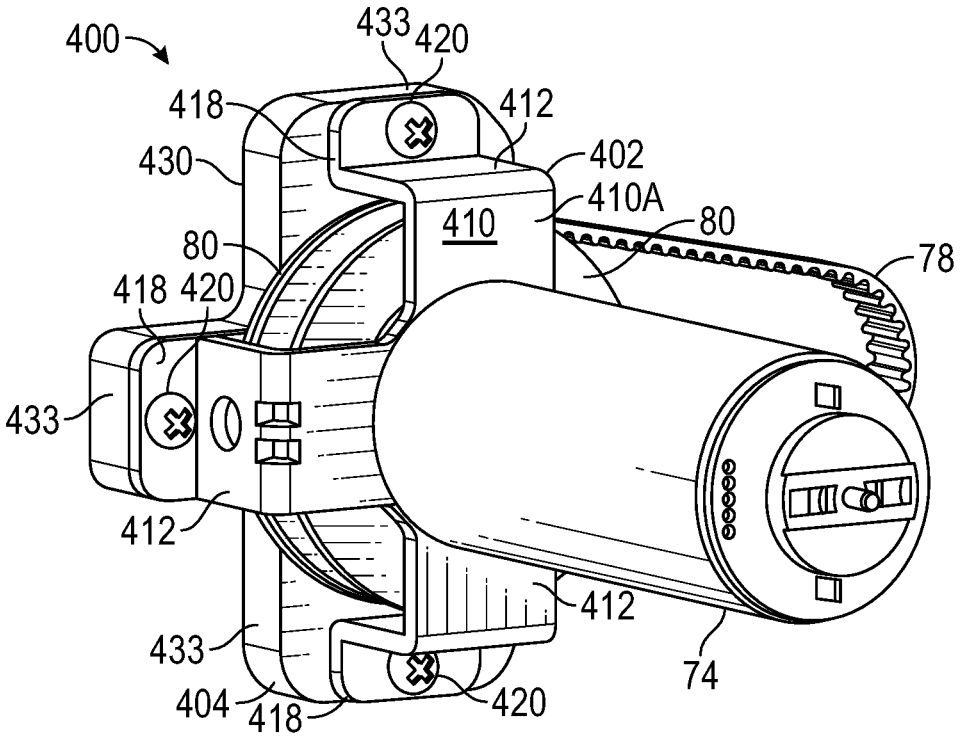
FIGS. 9A-9C show perspective side and cutaway views of a tensioned motor support assembly according to FIG. 8.
Figure 9B:
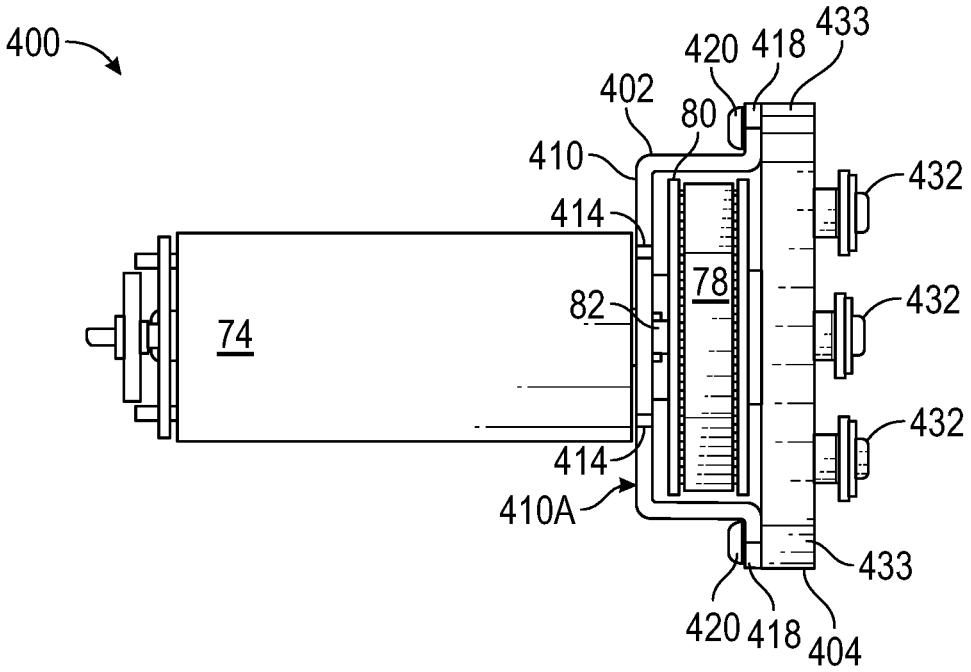
Figure 9C:
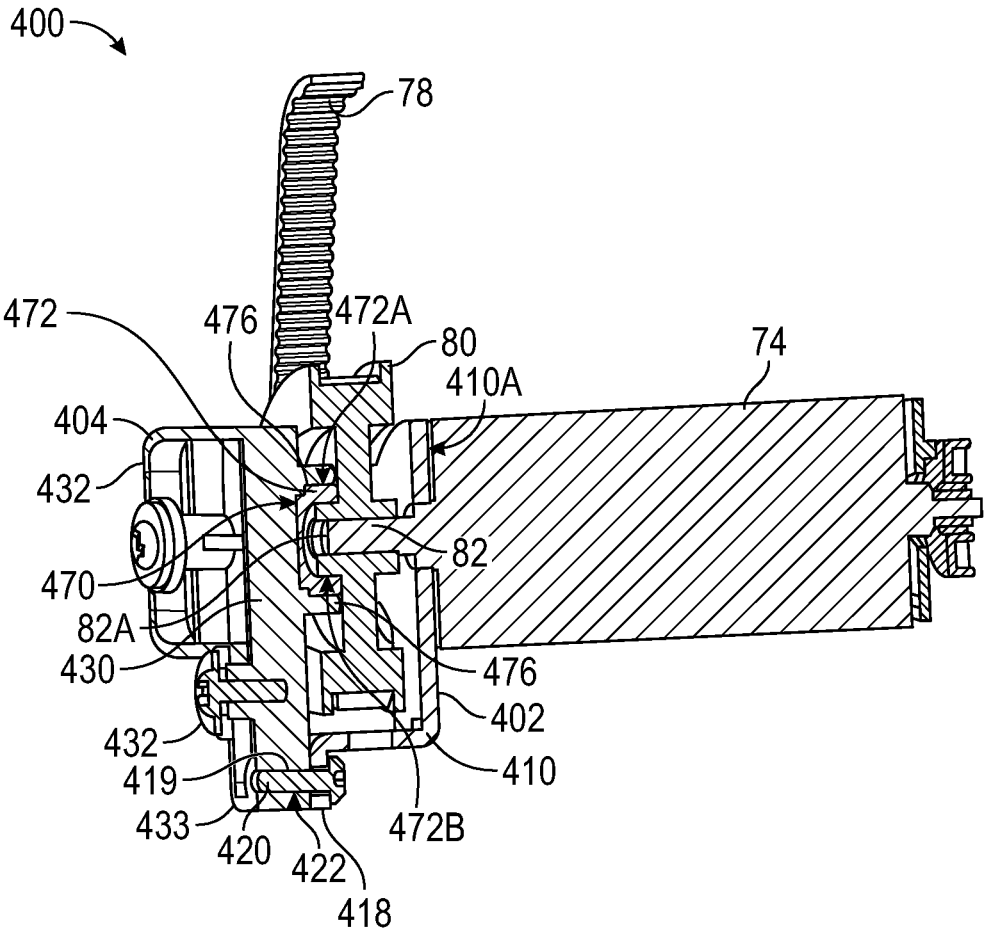
Figure 10A:
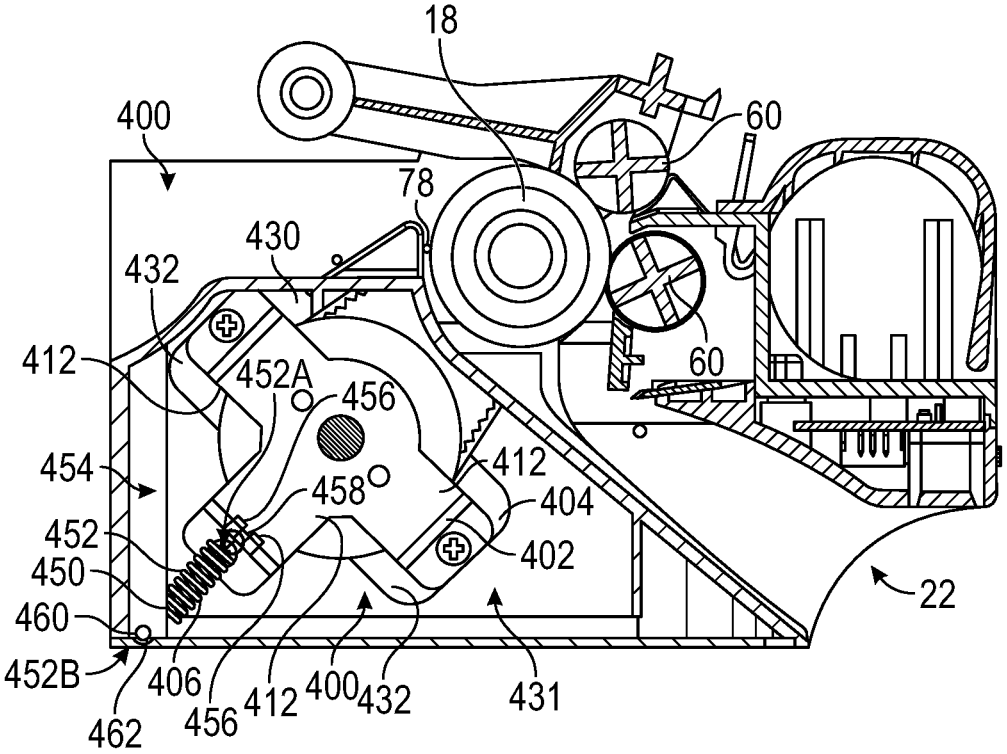
FIGS. 10A-10C show a biasing assembly for the tensioned motor support assembly of FIG. 8.
Figure 10B:
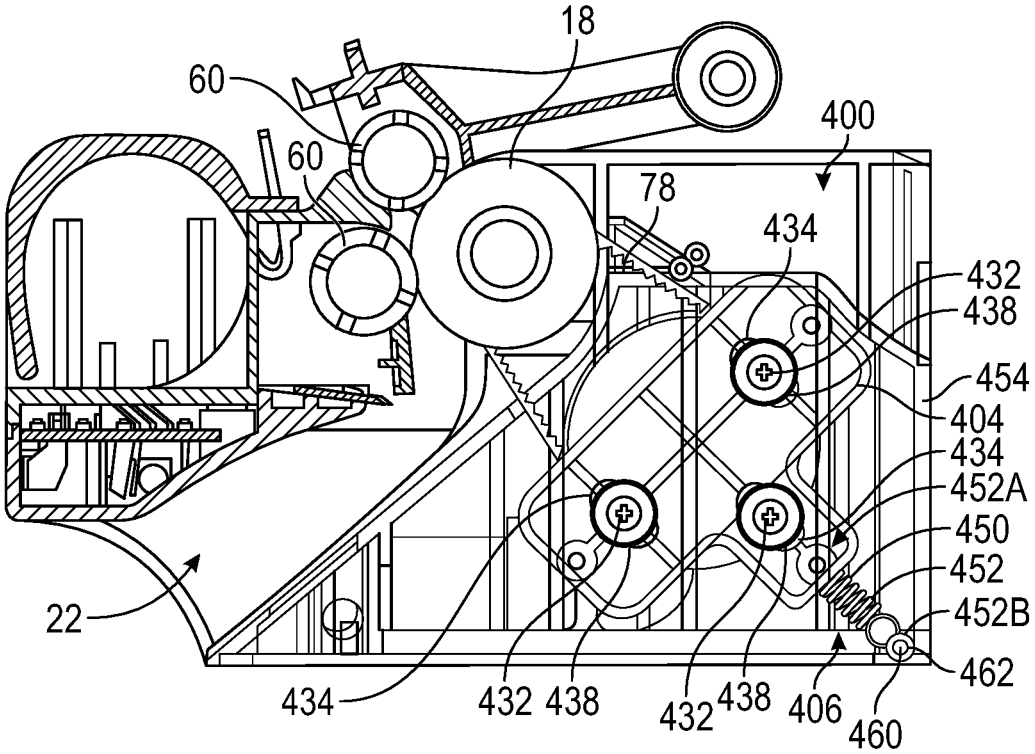
Figure 10C:
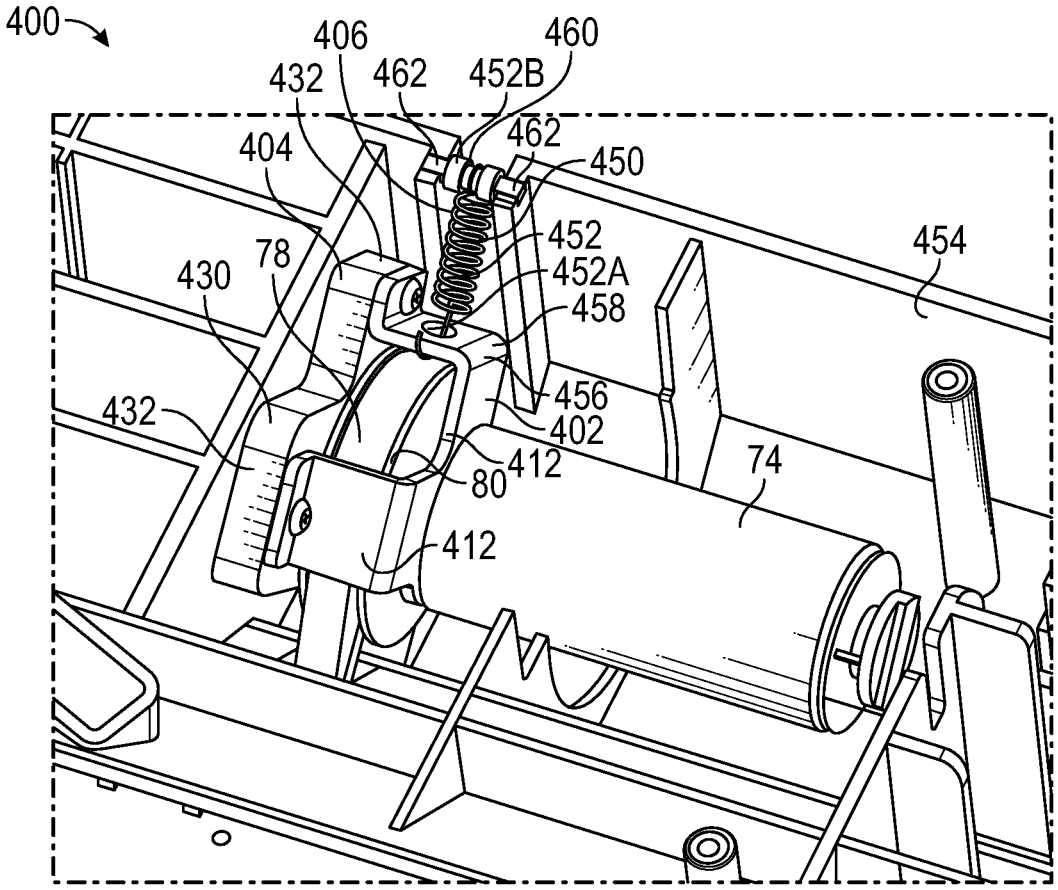
Figure 11A:
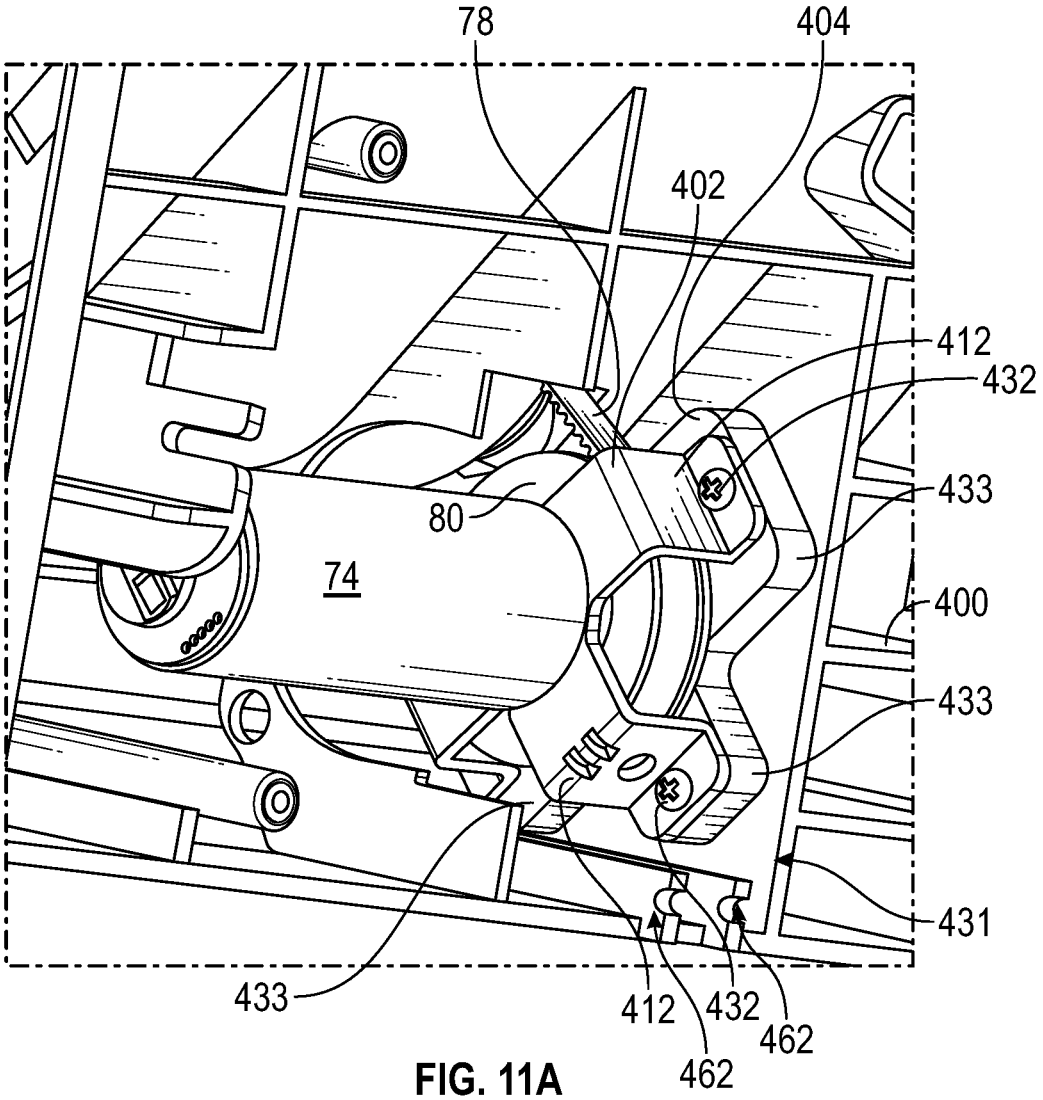
FIGS. 11A-11C show perspective views of connection of the tensioned motor support assembly of FIG. 8 to the housing of the dispenser.
Figure 11B:
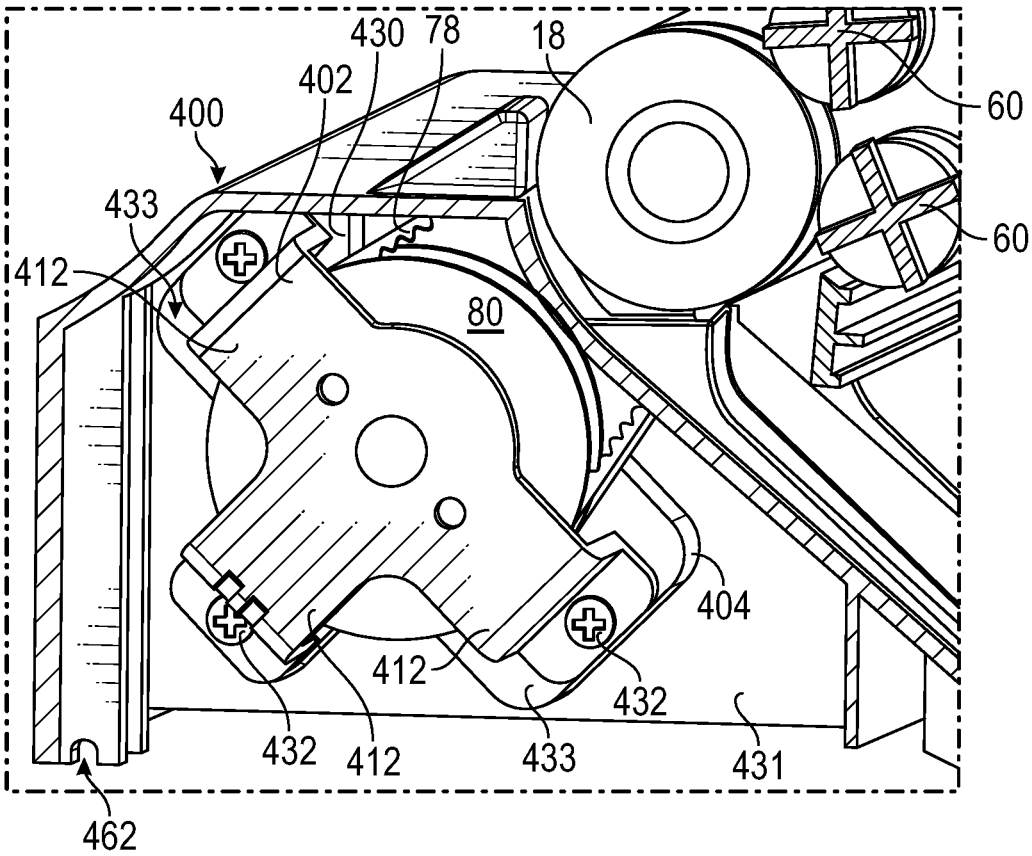
Figure 11C:
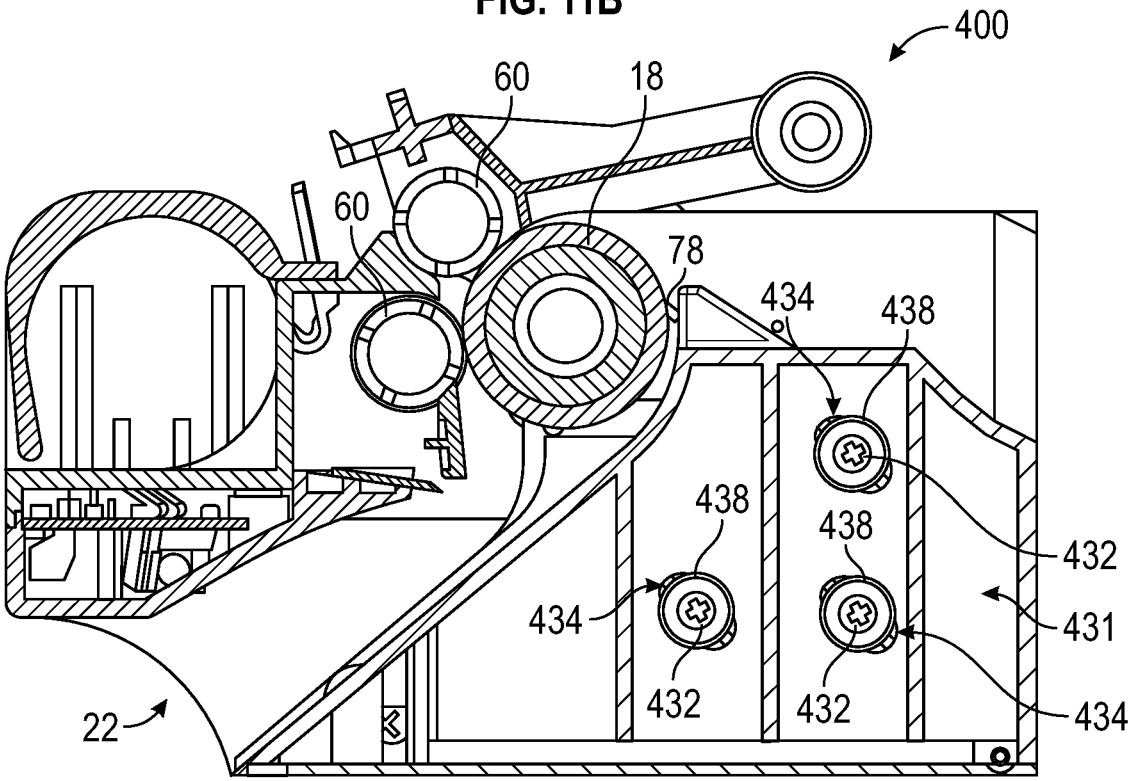

Additionally, the base 404 includes a body 430 with a plurality of protruding portions 433 extending therefrom that correspond and facilitate attachment to the plurality of supports 412 of the support frame 402 (FIGS. 8-11C). As shown in FIGS. 10A-11C, the base 404 is connected to an interior wall 431 of the dispenser housing 16 so as to allow for sliding or other suitable movement therebetween. For example, the base 404 is connected to the intermediate wall 431 of the dispenser housing 16 by a plurality of fasteners 432 (e.g., screws, bolts, etc.) that are received through slots 434 or other apertures shaped or configured to allow for sliding movement or other suitable of the fasteners 432 therealong (FIGS. 10B and 11C). The fasteners 432 further can be threaded into corresponding threaded holes 436 defined in the body 430 of the base 404 (FIG. 8).

In one embodiment, the body 430 of the base 404 is formed from polyoxymethylene ("POM"), also known as acetyl, polyacetyl, and polyformaldehyde. Other suitable plastic, polymeric, or synthetic materials having reduced frictional properties (e.g., a low surface friction) capable of enabling or allowing at least some sliding movement between the body 404 and a portion (e.g., an intermediate wall 431) of the dispenser housing 16 also can be used without departing from the scope of the present disclosure.

In addition, or in an alternative construction, the body 430 or can have a low-friction coating that allows for sliding movement between the base 404 and the interior wall 431. The fasteners 432 further can include/receive washers 438 thereabout that have a Teflon®, or other substantially low friction, coating, or are formed from a substantially low friction material (e.g., polyoxymethylene or other suitable polymeric or synthetic material), to further facilitate movement, e.g., sliding, between the base 404 and the intermediate wall 431.

As further shown in FIGS. 10A-10C, the biasing assembly 406 includes one or more biasing members 450 connected to/engaging the support frame 402 that provide a tensioning force or stress along the drive belt 78. In one embodiment, the biasing members 450 can include one or more tension springs or other suitable tensioning members having a spring body 452 that is connected to the support frame 402 and at least a portion (e.g., a rear wall 454) of the dispenser housing 16. Although a single spring biasing member 450 is shown in FIGS. 10A-10C, any number of springs or other suitable biasing mechanisms or combinations thereof can be used, without departing from the scope of the present disclosure.

FIGS. 10A-10C further show that the spring body 452 can include a first end 452A that includes a hooked, looped, or ring and is connected to the support frame 402, and a similarly constructed second end 452B (e.g., having a hook, loop, or ring) that is connected to the rear wall 454 of the dispenser housing 16. In one embodiment, one of the supports 412 includes notches or holes 456 defined therein that at least partially form an attachment portion or feature 458 that is sized, positioned, and/or configured to engage the hooked, looped, or ring end 452A of the spring body 452 (FIGS. 10A and 10C).

The biasing assembly 406 also can include a pin or rod 460 that is fitted or otherwise received within one or more grooves or notches 462 defined in or along the rear wall 454 of the dispenser housing 16, or portion or member attached thereto, and the pin or rod 460 can be connected to the second hooked, looped, or ring end 452B of the spring body 454 (FIGS. 10A-10C). The second end 452B can be otherwise connected or coupled to the dispenser housing 16 (e.g., to an opening or an attachment feature defined in the rear wall 454), without departing from the scope of the present disclosure.

FIGS. 8 and 9C show the support assembly 400 including a bearing assembly 470 that at least partially supports an end 82A of the driveshaft 82 of the motor 74 and the belt gear 80 received therealong, e.g., to prevent twisting or bending of the motor driveshaft 82 and other components of the drive assembly (e.g., under force/biasing of the biasing assembly) so as to substantially reduce, prevent, or inhibit uneven wear thereof or damage thereto. In one embodiment, the bearing assembly 470 can include one or more roller bearings 472, though other suitable bearings or bushings can be used without departing from the scope of the present disclosure. The bearing(s) 472 can be fitted or otherwise received within an opening or aperture 474 defined in the base 404 (e.g., the opening/aperture 474 can be at least partially defined by a protruding portion 476 of the base 404), such that an outer race 472A of the bearing 472 engages the base 404 (e.g., the protruding portion 476 thereof) and an inner race 472B of the bearing 472 engages the belt gear 80 received along the driveshaft 82 of the motor 74.

Accordingly, the support assembly 400 can be biased by the biasing assembly 406 to provide a tensioning force or stress along the drive belt 78. This tension along the drive belt 78 can substantially prevent, inhibit, or reduce wear of the drive belt 78, motor 74, or other components of the drive assembly. Furthermore, the support assembly 400 generally will be moveable/translatable under the control of the biasing assembly 406 (e.g., shock absorbing manner/arrangement) to provide dampening, shifting or moving in a substantially controlled, cushioned or vibration absorbing effects and/or movements of the motor 74 and other components of the drive assembly to substantially reduce noise generated thereby.

FIGS. 12-14C show a tensioned motor support assembly 500 according to yet another aspect of the present disclosure. As shown in FIGS. 12 and 13A-13C, the support assembly 500 includes a motor support portion 502 that is connected to the motor 74, and a pivot arm, pivoting bracket, or other movable portion 504 coupled to the motor support portion 502. The pivot arm 504 further connects the motor support portion 502, and the motor 74 generally supported thereby, to the dispenser housing 16. The support assembly 500 also includes a biasing assembly 506 (e.g., including one or more biasing members such as tension springs or other suitable tensioning or biasing members). The biasing assembly 506 generally is coupled to the pivot arm 504, which is pivotably or rotatably connected to the dispenser housing 16, such that the support assembly 500 can move, e.g., generally under the control of the biasing assembly 506, to provide a substantially constant tension, stress, or force along the drive belt 78 and/or to substantially dampen or absorb vibrations of the motor 74 or other components of the drive assembly during operation thereof.

The support assembly 500 further can include a bearing assembly 570 (e.g., including a bearing, bushing, etc.) that engages the pivot arm 504 and the belt gear 80 to at least partially support the driveshaft 82, e.g., to substantially reduce, inhibit, or prevent bending or twisting of the driveshaft 82 (e.g., due to the urging of/force of the biasing assembly 506), to help to substantially prevent, reduce, or inhibit premature and/or uneven wear or other damage to the components of the motor 74 and/or drive assembly.

Figure 14A:
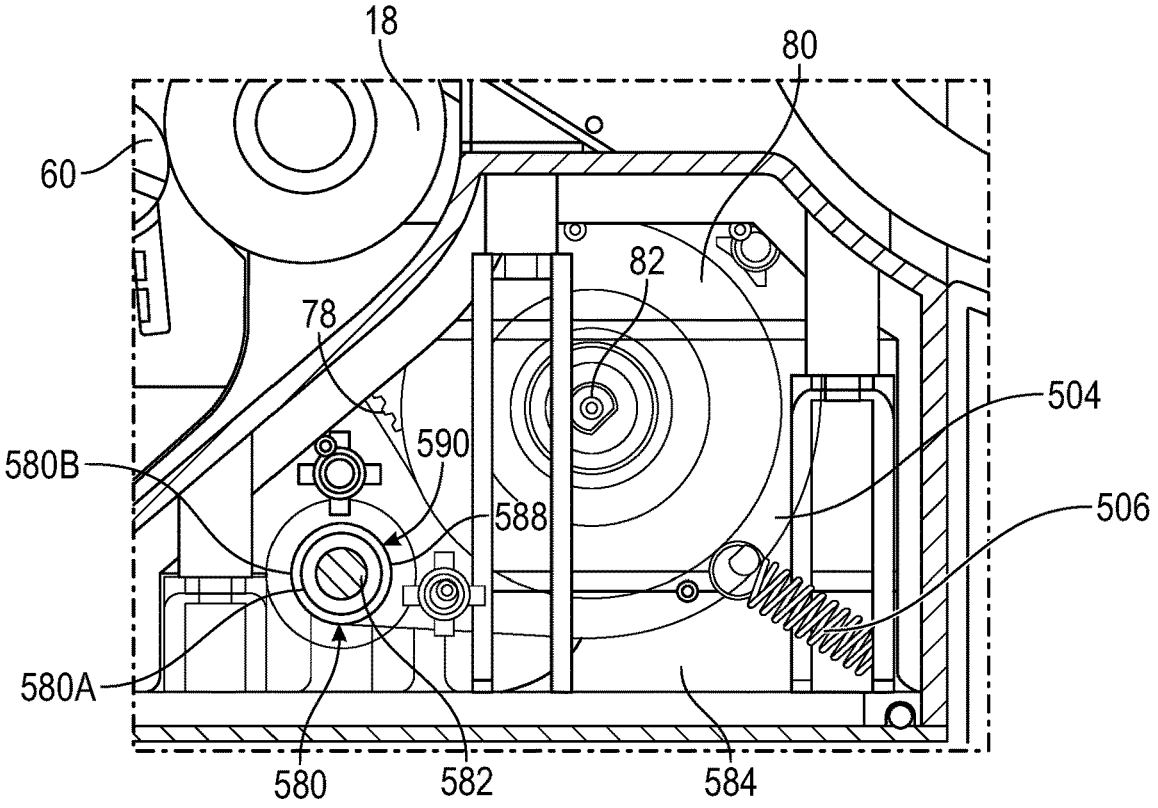
FIGS. 14A-14C show cross-sectional and perspective views of the connection of the tensioned motor support assembly of FIG. 12 to the dispenser housing.
Figure 14B:
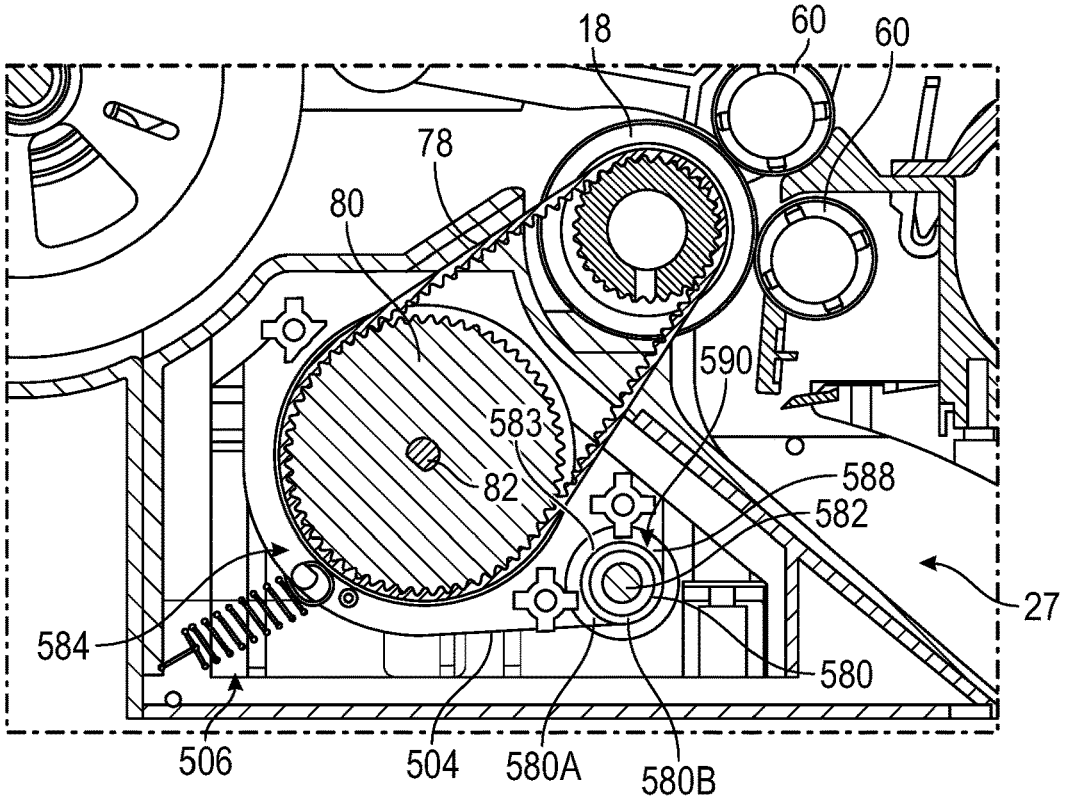
Figure 14C:
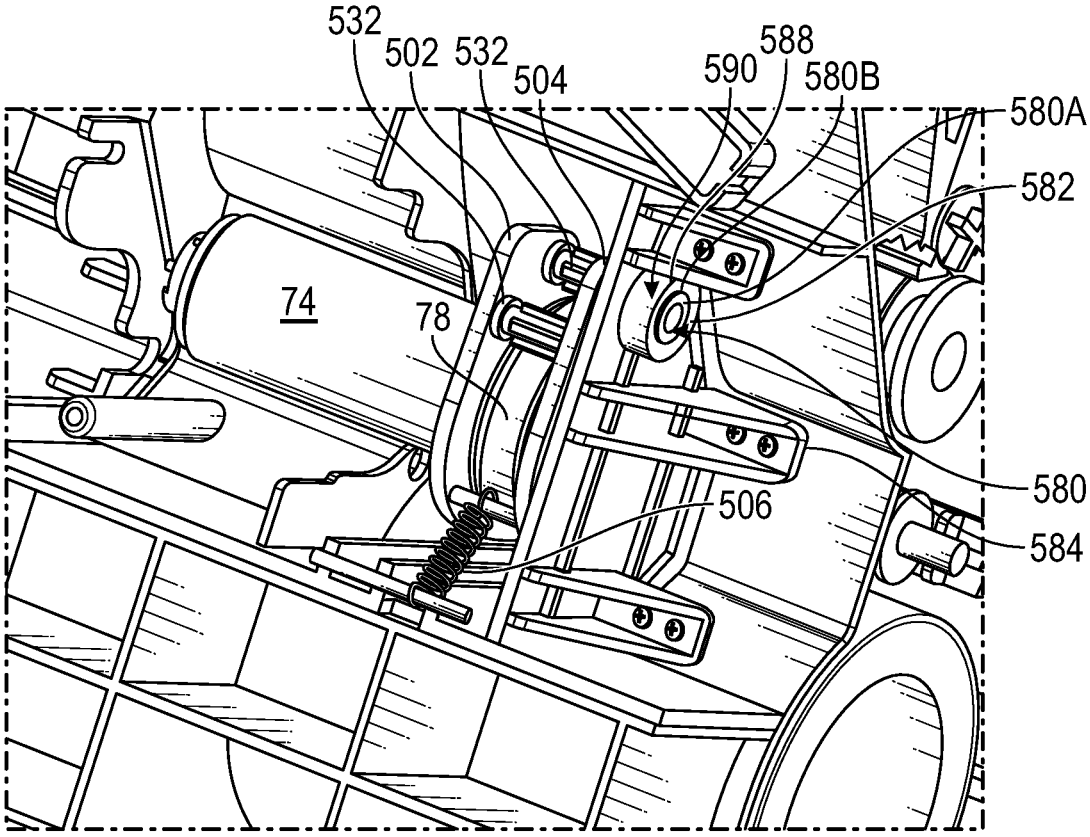

As shown in FIGS. 12-14C, the support assembly 500 also can include a bearing assembly 580 for pivotably or rotatably connecting the support assembly 500 to the dispenser housing 16. In one example embodiment, the bearing assembly 580 can include one or more roller bearings or other suitable bearings, bushings, or mechanisms that allow for pivoting/rotation, which bearings can engage the pivot arm 504 (e.g., engaging or connecting to or formed with a projecting portion or other support 582 connected to or formed with the pivot arm 504), and an intermediate wall 584 that is connected to, or formed as part of, the dispenser housing 16. For example, as shown in FIGS. 14A-14C, an inner race 580A of the bearing assembly can engage the projecting portion 582 of the pivot arm 504 and an outer race 580B of the bearing 580 can engage a surface 588 defined by an opening or aperture 590 provided or defined in the intermediate wall 584. As a result, the support assembly 500 will be rotatably/pivotably connected to the intermediate wall 584 such that the support assembly 500 can pivot/rotate thereabout, under the control of the biasing assembly 506, e.g., allowing the biasing assembly 506 to act as a shock absorber or dampener to substantially dampen, reduce, or absorb vibrations/movement during operation of the motor, or other components of the drive assembly, as well as to provide a substantially constant tension force/stress along the drive belt 78, which further can help substantially reduce, inhibit, or prevent premature wear thereof.

Figure 12:
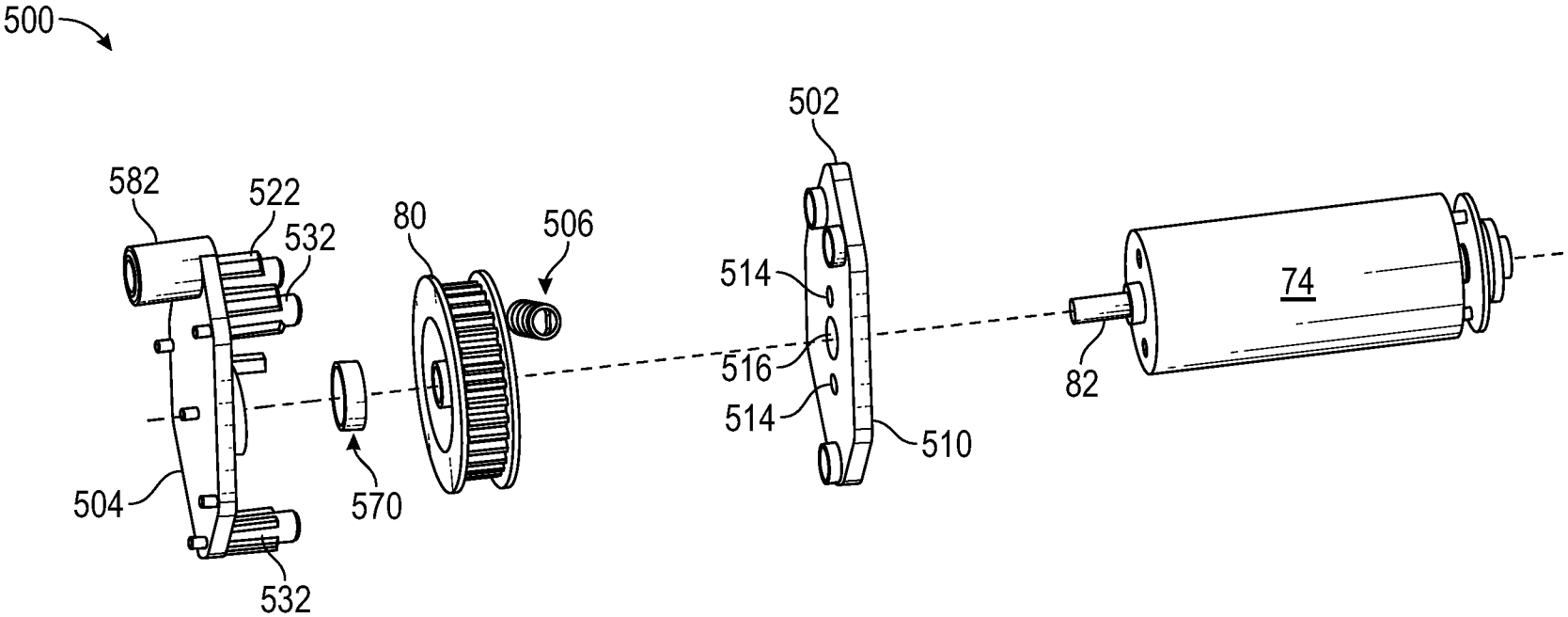
FIG. 12 shows an exploded view of a tensioned motor support assembly for the motor according to one aspect of the present disclosure.
Figure 13A:
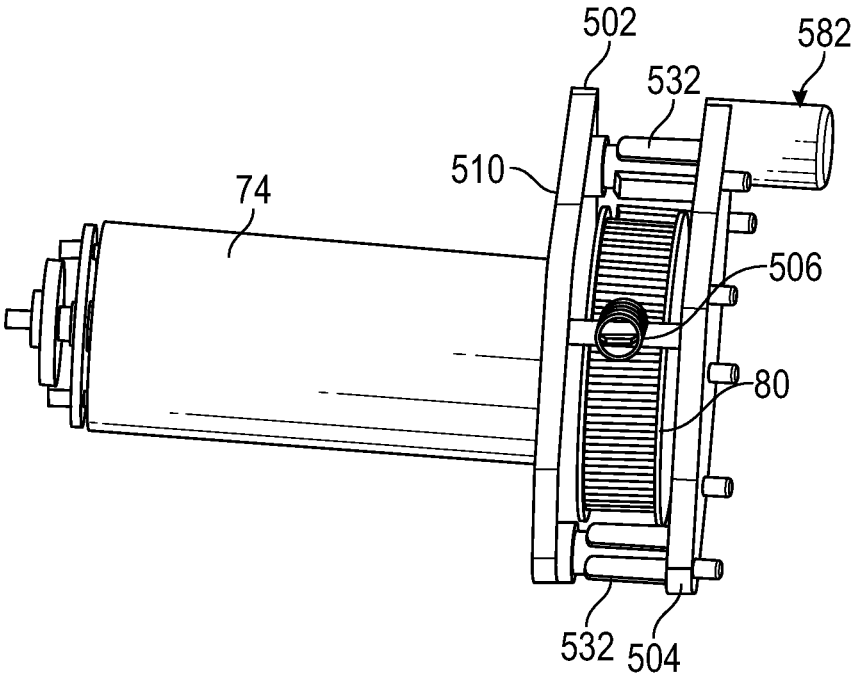
FIGS. 13A-13C show perspective and cross-sectional views of the tensioned motor support assembly according to FIG. 12.
Figure 13B:
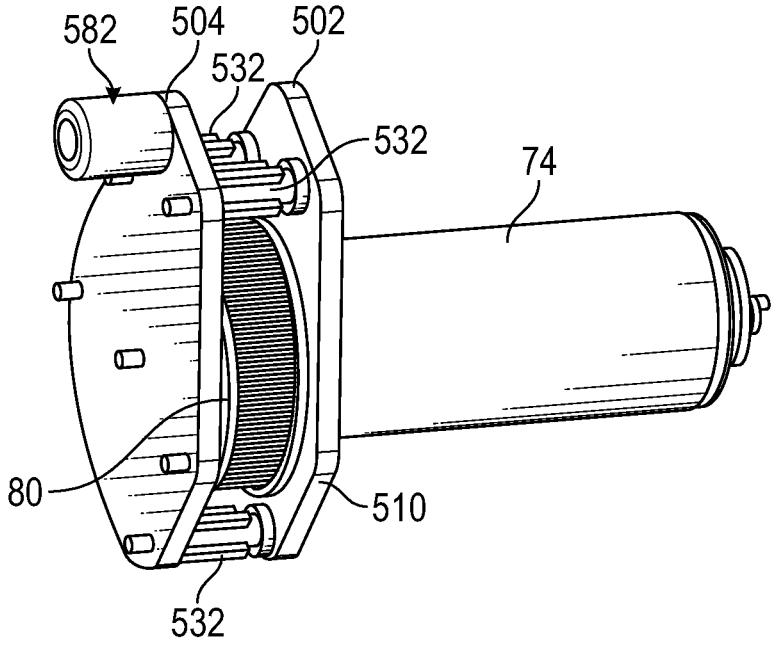
Figure 13C:
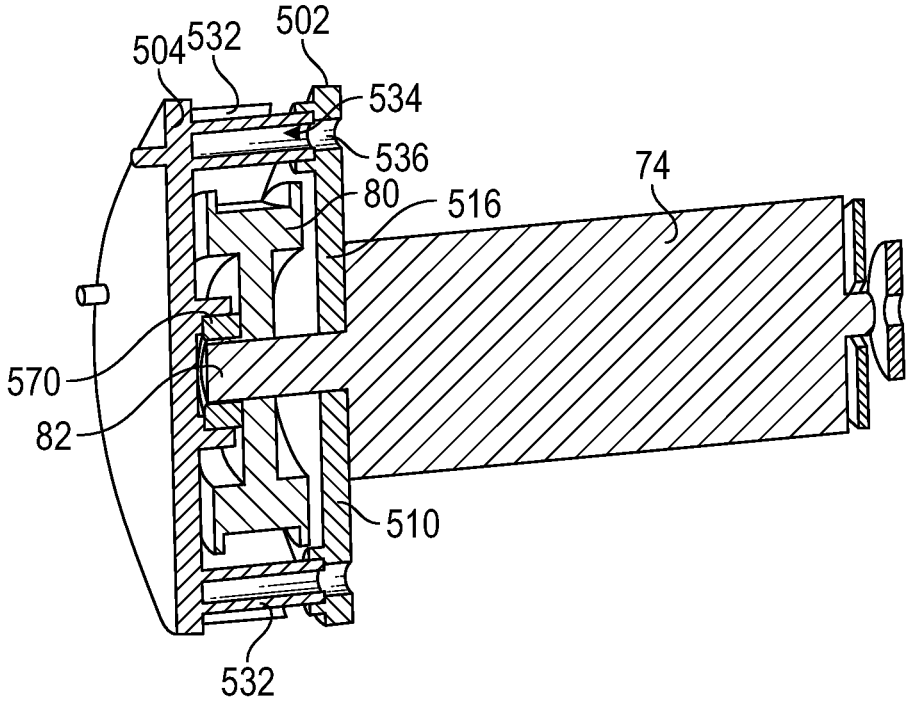

Further, in the embodiment shown in FIGS. 12-14C, the support portion 502 generally includes a body 510 with a plate-like structure and one or more holes or apertures 514 defined therein (see FIG. 12) for receiving fasteners (e.g., screws, bolts, etc.) to couple the support portion 502 to the motor 74. The motor support portion 502 has an aperture or opening 516 that allows for passage of the driveshaft 82 of the motor 74 to be coupled to the belt gear 80 (FIGS. 12 and 13C). The body 510 of the motor support portion 502 further can be formed from a metal, such as aluminum or steel, though other metallic materials, composite materials, or polymeric materials can be used without departing from the scope of the present disclosure.

Still further, in the embodiment shown in FIGS. 12-14C, the pivot arm 504 can include a body 530 with a plate-like structure that has a series of posts or support portions 532 provided therealong. The support portions 532 can include threaded holes or apertures 534 defined therein configured to couple to one or more fasteners that are received through corresponding openings or holes 536 defined in the motor support portion 502 to fixedly connect the support portion 502 and the pivot arm 504 (FIG. 13C). The projecting portion 582 for engaging the bearing assembly 580 also can be formed with, or otherwise connected to, the body 530 of the pivot arm 504. In one embodiment, the body 530 of the pivot arm 504 can be formed from a reduced friction material, such as polyoxymethylene ("POM"), though other suitable plastics, synthetics, polymeric materials, or combinations thereon can be used without departing from the scope of the present disclosure.

FIGS. 15A-15D, 16A-16C, and 17A-17B, show a tensioned motor support assembly 600 according to yet another aspect of the present disclosure. As shown in FIGS. 15A-15D, 16A-16C, and 17A-17C, the support assembly 600 includes a motor support portion 602 that is connected to the motor 74, and a pivot arm/bracket or movable pivot arm 604 that is coupled to the motor support portion 602 and rotatably or pivotally coupled to the dispenser housing 16. The support assembly 600 further includes a biasing assembly 606 (e.g., including one or more biasing members 607 such as tension springs or other suitable tensioning or biasing members).

The biasing assembly 606 generally is coupled to or otherwise in communication with the pivot arm 604 and the motor support portion 602, such that the support assembly 600 can pivot, rotate, or otherwise move, e.g., under the control of the biasing assembly 606, to provide a substantially constant tension stress or force along the drive belt 78 and/or to dampen or absorb vibrations of the motor 74 or other components of the drive assembly during operation thereof. For example, as shown in FIGS. 15A-15D, a first end 607A (e.g., having a hook, hoop, ring, etc.) of the biasing member(s) 607 is connected to or otherwise engages a rod, pin, or other suitable portion 609 that is connected to and extends between the pivot arm 604 and the support portion 602 (e.g., the rod 609 can be received within one or more corresponding openings, notches, etc. defined in the pivot arm 604 and motor support portion 602). As further shown in FIGS. 15A-15D, a second end 607B (e.g., having a hook, hoop, ring, etc.) of the biasing member(s) 607 is connected to or otherwise engages a rod, pin, or other suitable portion 611 that is connected to the dispenser housing 16 (e.g., is received within corresponding notches 613 or other suitable openings defined along one or more portions of the dispenser housing 16).

FIGS. 15A-15D and 16A-16C further show that the support assembly 600 includes a bearing assembly 610 for pivotably or rotatably connecting the pivot arm 604 to the dispenser housing 16. The bearing assembly 610 can include one or more bearings 612/614 (e.g., roller bearings or other suitable bearings, bushings, or mechanisms that allow for pivoting/rotation) that are connected to or otherwise engage the pivot arm 604, and an intermediate wall or portion 616 that is connected to, or formed as part of, the dispenser housing 16. The intermediate portion 616 can include an interior wall or portion that is formed with the dispenser housing 16, or can include a separate, detachable or fixed portion or part that is connected to the dispenser housing 16 by one or more fasteners, or by other suitable connections mechanism, e.g., adhesives, snap-fittings, etc.

Figure 16A:
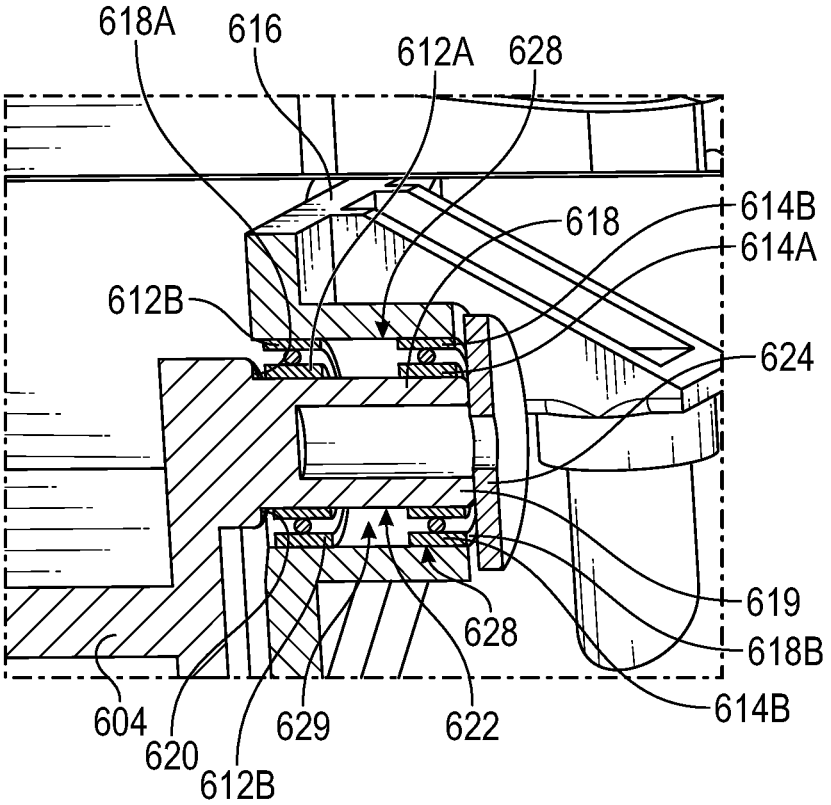
FIGS. 16A-16C show cross-sectional and perspective views of a bearing assembly for the motor support assembly of FIGS. 15A-15D.
Figure 16B:
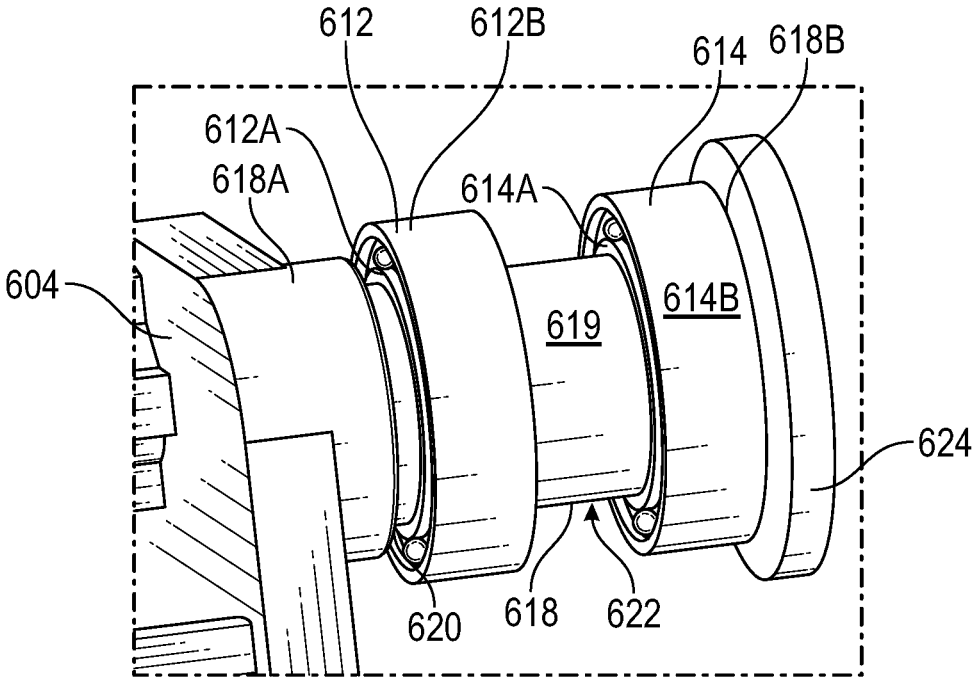
Figure 16C:
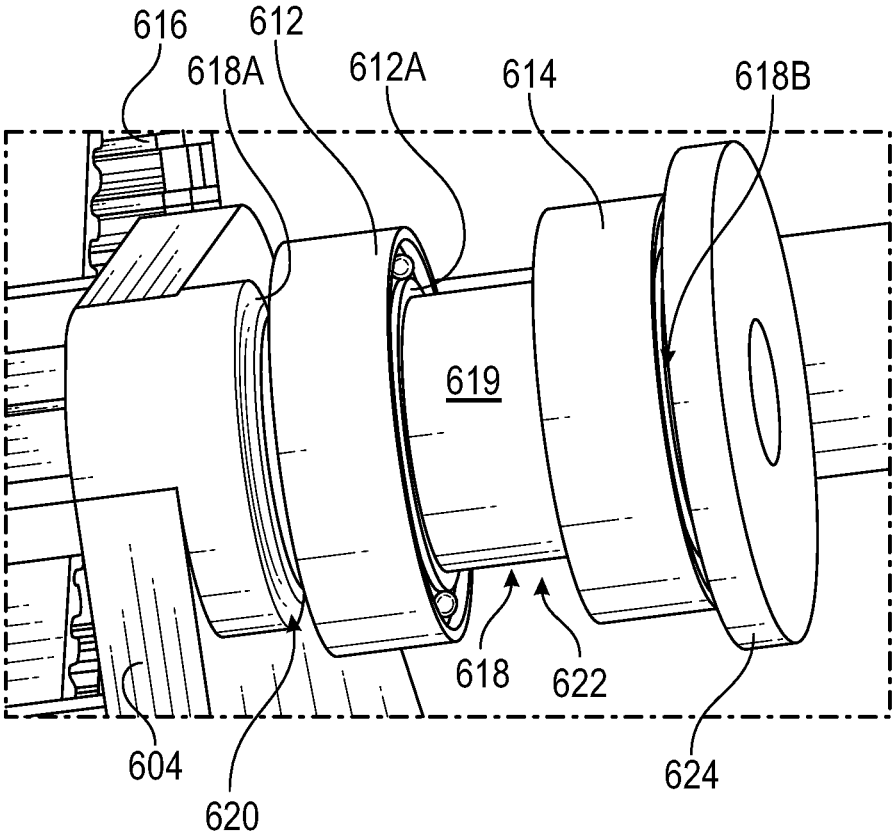

In one embodiment, as shown in FIGS. 16A-16C, the bearing assembly 610 generally includes a plurality of bearings 612/614 that are received about a projecting portion or other suitable support 618 connected to or formed with the pivot arm 604. The plurality of bearings 612/614 can be spaced apart along the projecting portion 618. For example, a first bearing 612 can be positioned substantially adjacent or substantially proximate to a first end 618A of the support 618, while a second bearing 614 can be positioned substantially adjacent or substantially proximate to a second end 618B of the support portion 614B. The pivot arm 604 further has a shoulder or face 620 formed/defined along the projecting portion 618 about its first end 618A (e.g., defined by a reduced diameter portion 622 of the projection portion 618), and as generally shown in FIGS. 16A-16C, the first bearing 612 can be positioned substantially adjacent to or in engagement or contact with the shoulder 620 (so as to substantially prevent, reduce, or inhibit movement or dislocation of the bearing 612). A cap or other suitable portion 624 can be connected to the second end 618B of the projecting portion 618, so as to engage or contact the bearing 616 (e.g., to substantially prevent, reduce, or inhibit movement or dislocation of the bearing 614). The cap 624 can be fixed to the support or projecting portion 618 by an adhesive, though other connections are possible without departing from the scope of the present disclosure.

Additionally, the bearings 612 and 614 can be received within, such as by press-fitting into, an opening or passage 628 defined in the intermediate portion/wall 616, such that an inner race 612/614 of the bearing assembly engages an exterior surface 619 of the support or projecting portion 618 of the pivot arm 604 and an outer race 612A/614B of the bearing 612/614 engages an interior surface 629 defined by the opening 628 provided or defined in the intermediate portion/wall 616, as generally shown in FIGS. 16A-16C. Accordingly, the support assembly 600 will be rotatably/pivotably connected to the intermediate portion/wall 616 such that the support assembly 600 can pivot/rotate thereabout, under the control of the biasing assembly 606, e.g., allowing the biasing assembly 606 to act as a shock absorber or dampener to substantially dampen, reduce, or absorb vibrations/movement during operation of the motor, or other components of the drive assembly, as well as to provide a substantially constant tension force/stress along the drive belt 78, e.g., to help to substantially reduce, inhibit, or prevent premature wear thereof.

In one embodiment, the outer race 612A/614B of each bearing 612/614 further can include, or receive thereabout, a material having a desired degree of give or compressibility, such as a material formed from rubber or other suitable dampening material, such as plastics, synthetics, etc. to provide dampening or absorbing of vibrations between the pivot arm 604 and intermediate portion/wall 616 during operation of the motor or other components of the drive mechanism.

Further, in the embodiment shown in FIGS. 15A-15D, the support portion 602 generally includes a body 640 with a plate-like structure and one or more holes or apertures defined therein for receiving fasteners (e.g., screws, bolts, etc.) to couple the support portion 602 to the motor 74. The motor support portion 602 also has an aperture or opening that allows for passage of the driveshaft 82 of the motor 74 to be coupled to the belt gear 80. The body 640 of the motor support portion 602 further can be formed from a plastic material, such as polyoxymethylene ("POM") or other polymeric materials, though other suitable materials, such as composite materials, metallic materials, or combinations thereof, can be used without departing from the scope of the present disclosure.

Figure 17A:
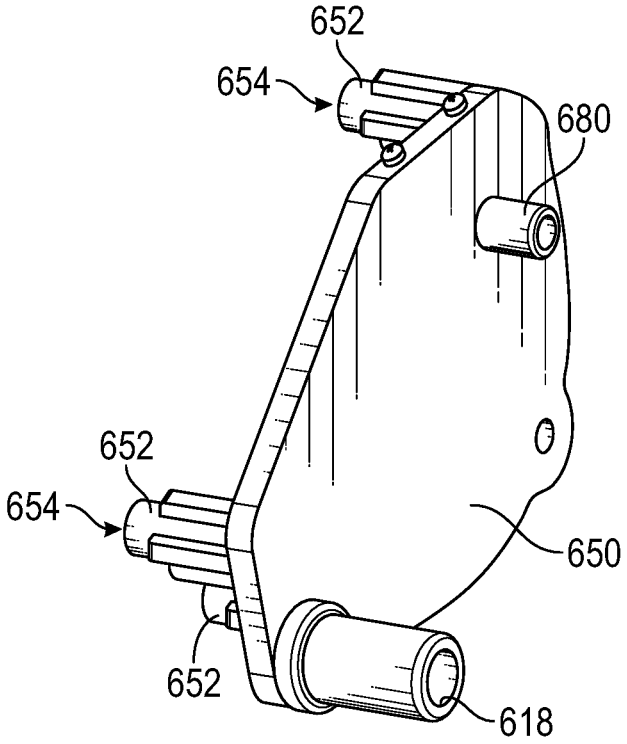
FIGS. 17A-17B show perspective views of a pivot arm/portion for the motor support assembly of FIGS. 15A-15D.
Figure 17B:
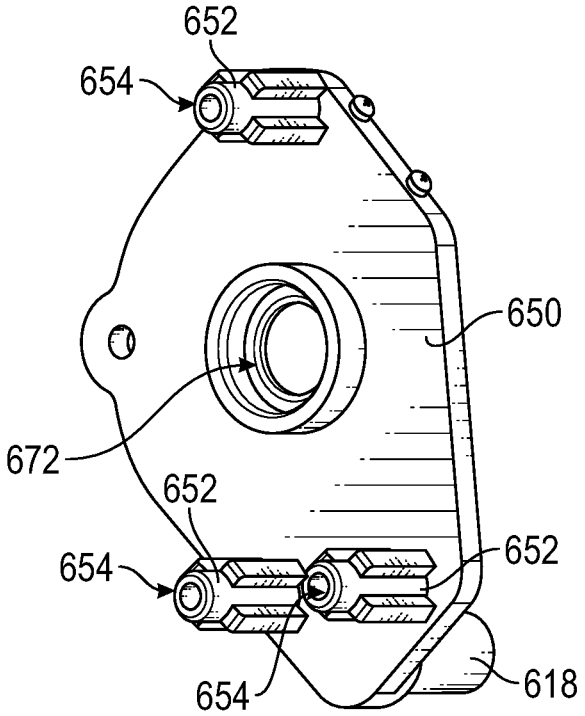

FIGS. 17A and 17B show that the pivot arm 604 can include a body 650, which can include a plate-like structure with a series of posts or supports 652 spread thereabout. These supports 652 can include threaded holes or apertures 654 defined therein configured to couple to one or more fasteners that are received through corresponding openings or holes defined in the motor support portion 602 to fixedly connect the motor support portion 602 and the pivot arm 604. The projecting portion 618 for the bearings 612/614 also can be formed with, or otherwise connected to, the body 650 of the pivot arm 604. In one embodiment, the body 650 of the pivot arm 604 can be formed from a reduced friction material such as polyoxymethylene ("POM"), though other suitable plastics, synthetics, or polymeric materials also can be used without departing from the scope of the present disclosure.

The support assembly 600 further can include a bearing assembly (e.g., similar to bearing assembly 570) that is at least partially received within and engages an opening or passage 672 defined along the pivot arm 604 (such that the bearing assembly is supported thereby), and that also engages the belt gear 80. The support assembly 600 thus can at least partially support the driveshaft 82, while also helping to substantially reduce, inhibit, or prevent bending or twisting of the driveshaft 82 (e.g., due to the urging of/force of the biasing assembly 506), and help reduce or inhibit premature and/or uneven wear or other damage to the components of the motor 74 and/or drive assembly.

Figure 15A:
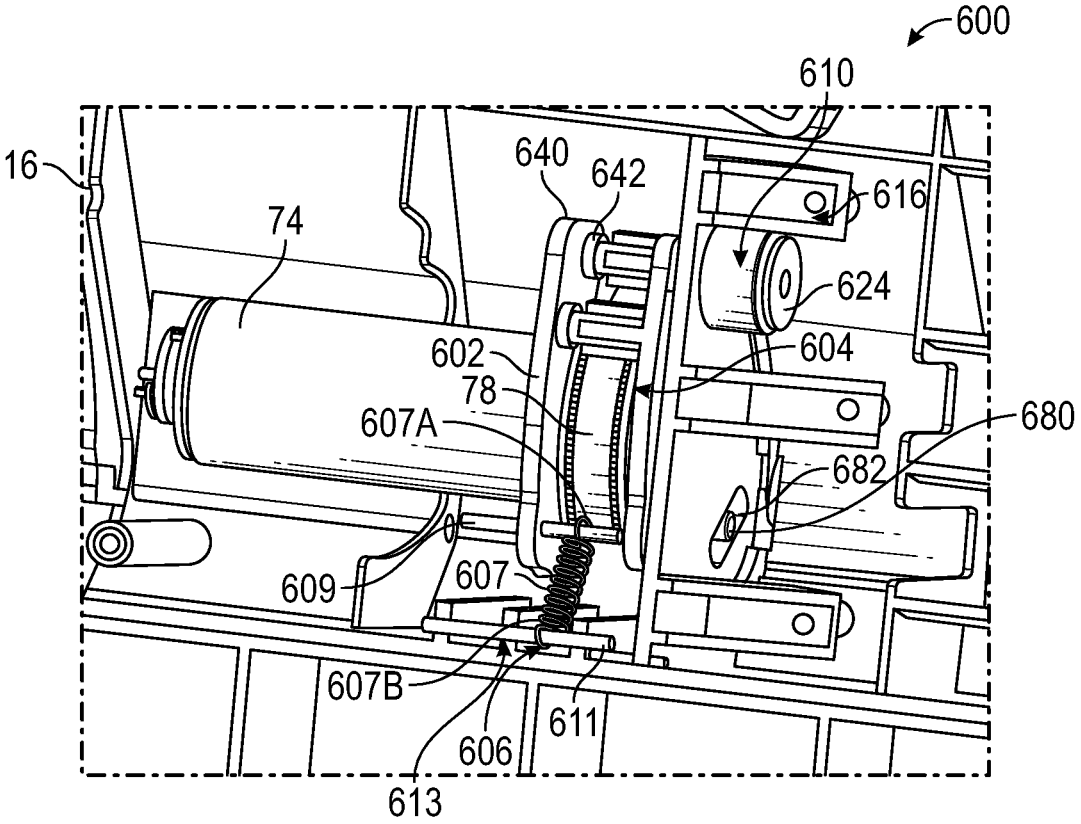
FIGS. 15A-15D show perspective views of a tensioned motor support assembly for the motor according to one aspect of the present disclosure.
Figure 15B:
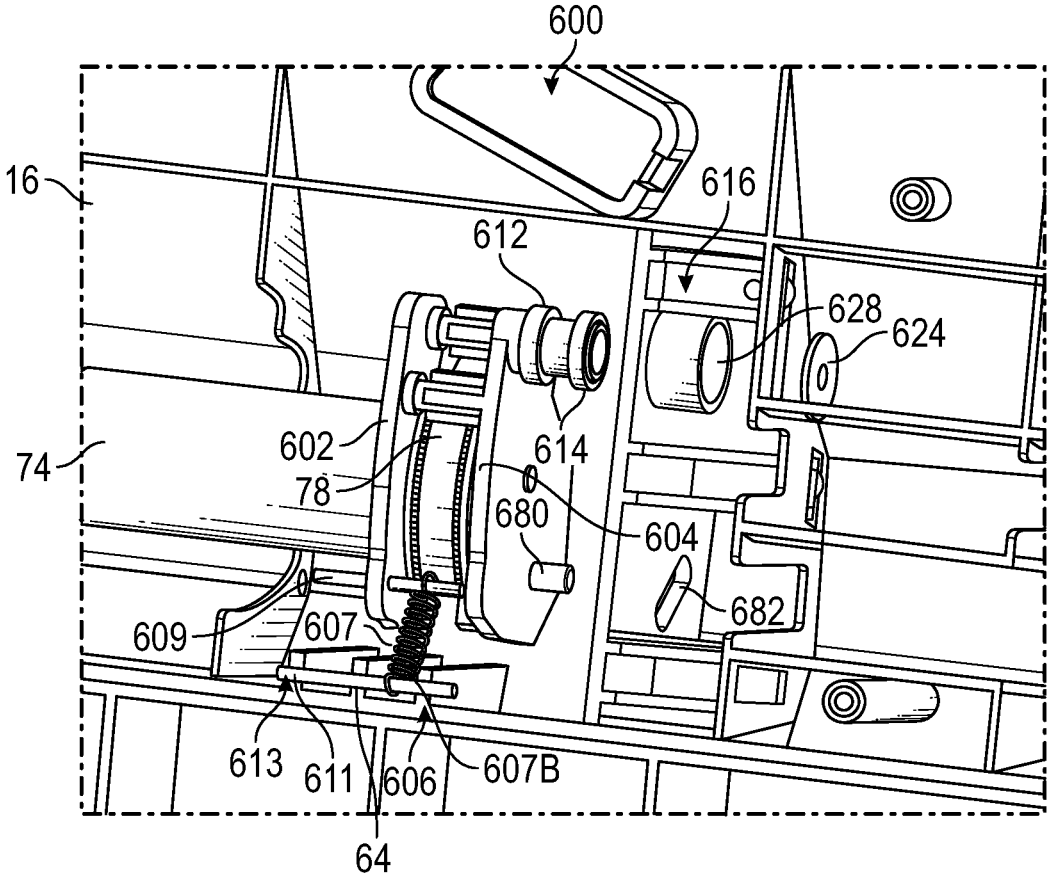
Figure 15C:
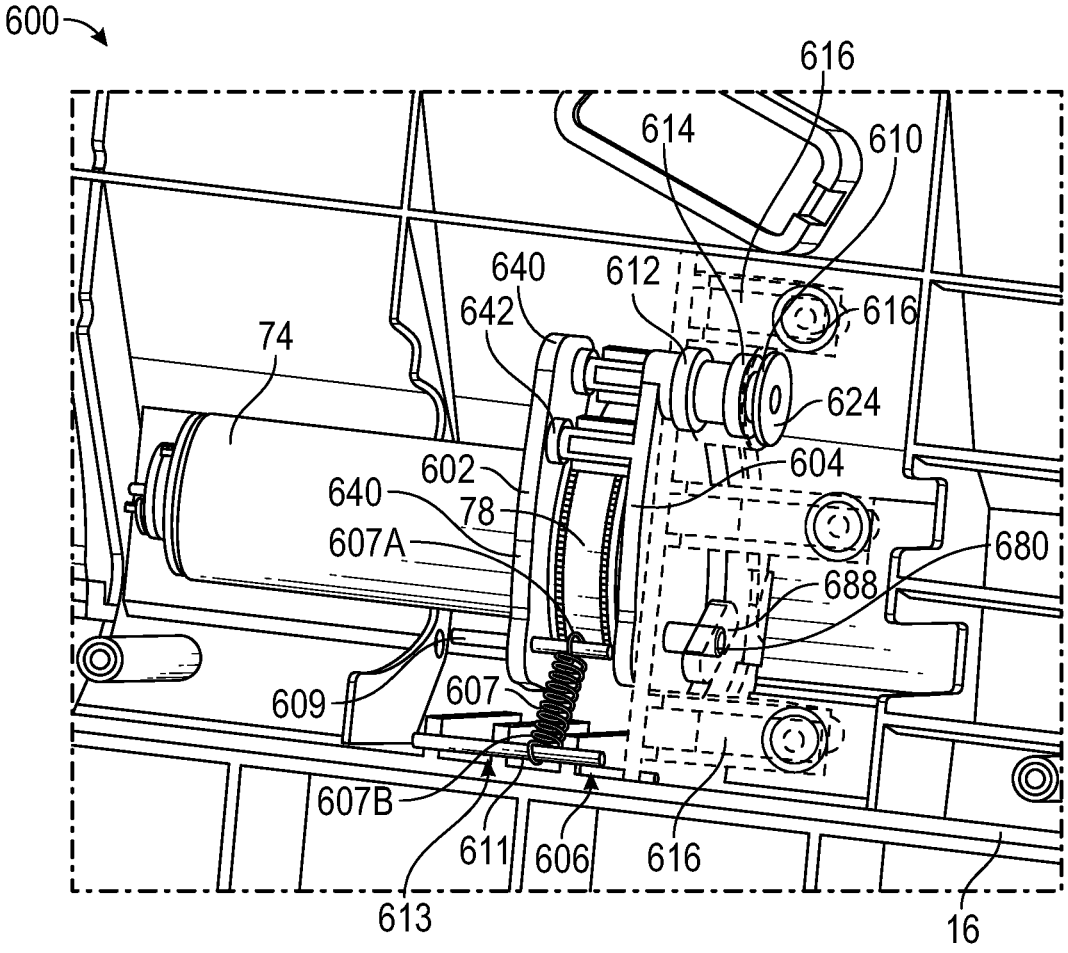
Figure 15D:
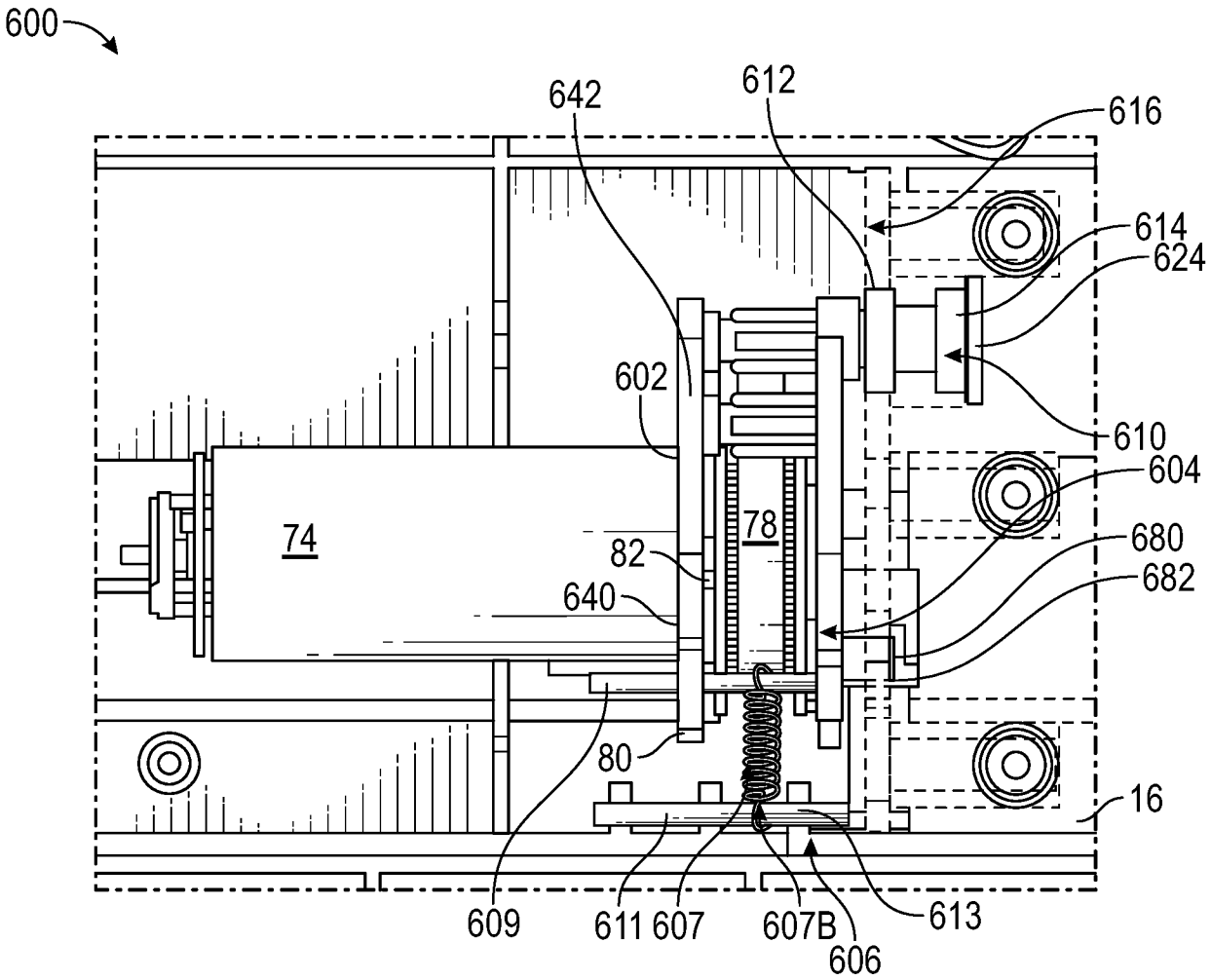

Optionally, as shown in FIGS. 15A-15B, the pivot arm 604 can include at least one post 680, or other suitable projecting portion, that is received within a corresponding slot or opening 682 defined within the intermediate portion/wall 616. The slot 682 allows movement of the pivot arm 604, generally under the control of the biasing assembly 606, and further allows for the post 680 to engage or contact the intermediate portion/wall 616, e.g., to help to provide support/stabilization of the support assembly 600 and/or to reduce the stress/forces at the bearing assembly 610.

Figure 3A:
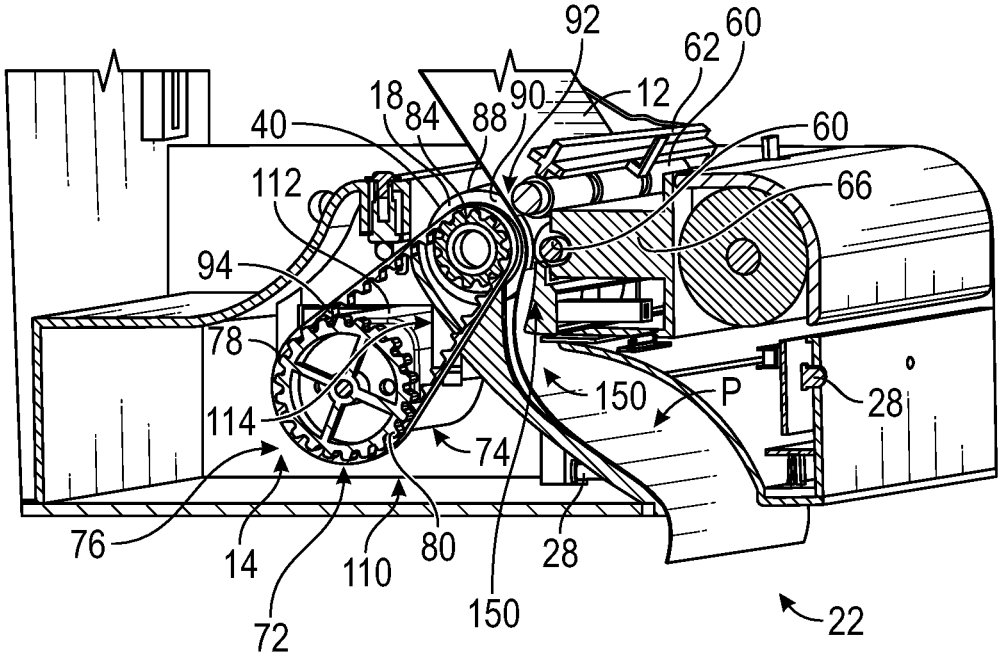
FIGS. 3A-B show cross-sectional, partial cutaway views of a feed roller drive assembly/system for a dispenser according to principles of this disclosure.
Figure 3B:
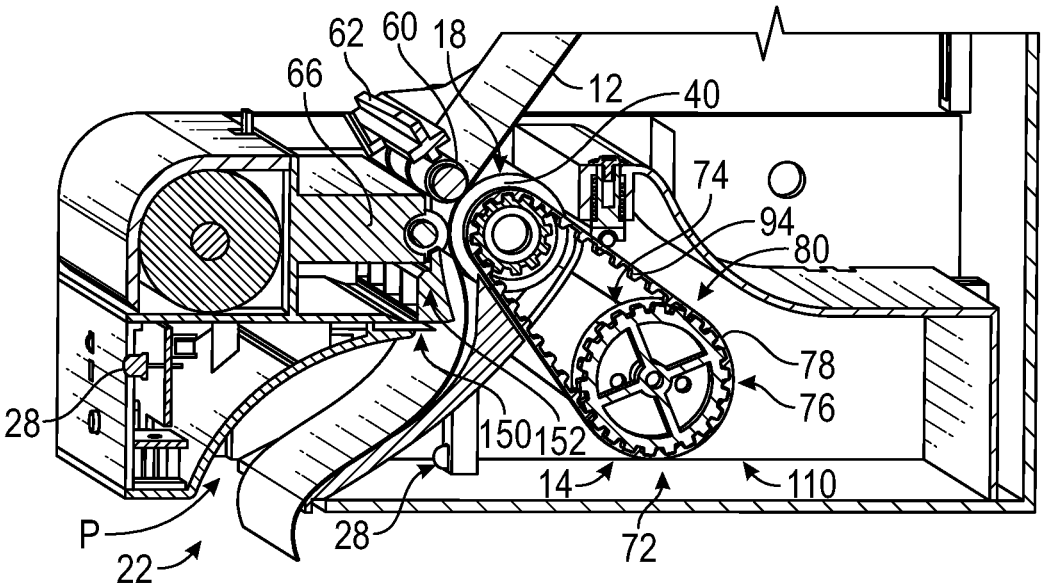

As shown in FIGS. 3A and 3B, the dispenser assembly may include one or more tear bars or other suitable cutting members 150 disposed adjacent or along the discharge throat or chute of the dispenser housing so that a user can separate a sheet or measured amount of the material by grasping and pulling the sheet across the tear bar 150. In addition, a movably mounted pawl member 152 can be located proximate to the stationary tear bar 150 such that movement of sheet material 12 into the tear bar 150 for severance moves the pawl member 152 between multiple positions. A signal device such as a proximity sensor, switch, or the like, that is cooperative with the pawl member 152, also can be arranged such that movement of the pawl member 152 between various positions causes the signal means to send a signal to notify the control circuit that the sheet material has been removed. The signal means can include infrared emitters/detectors, or a mechanical switch. After receiving a signal that sheet material 12 may have been removed, the control circuit can activate a paper detection sensor to verify that the sheet material has been removed from the discharge 22.

Figure 18:
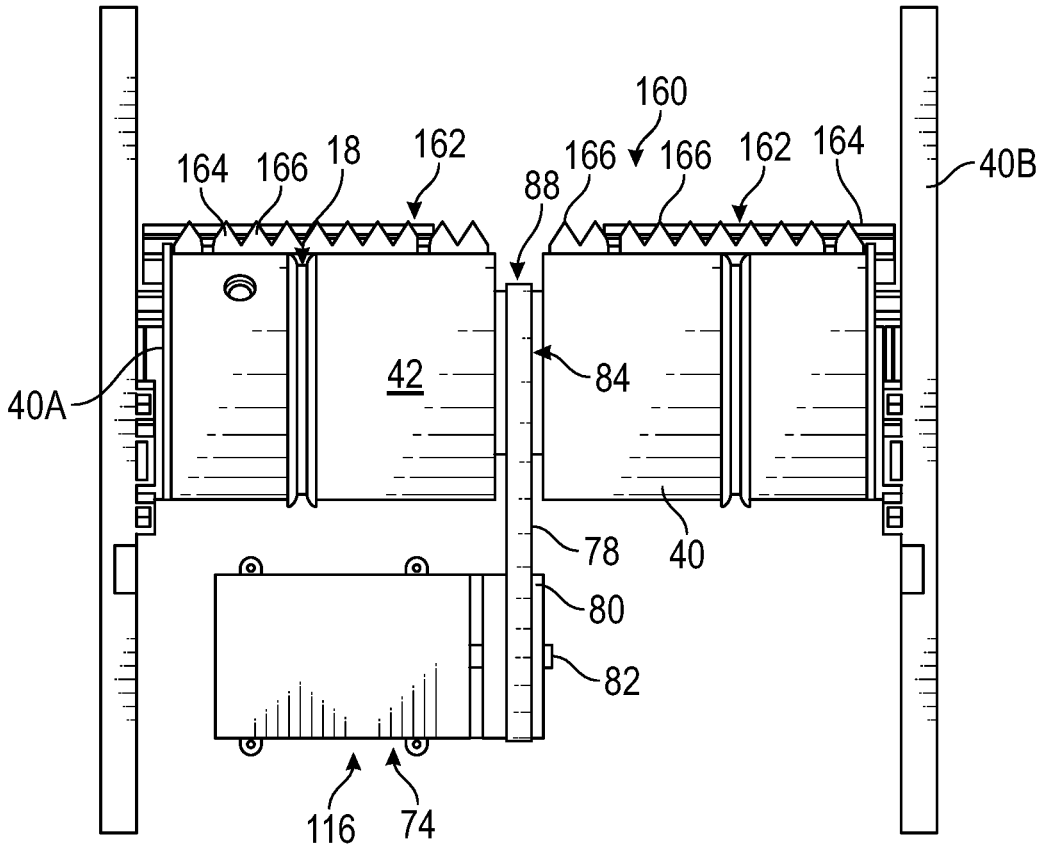
FIG. 18 is a schematic view of a cutting assembly/system for use with a dispenser assembly according to one aspect of this disclosure.

As indicated in FIG. 18, in an additional or alternative construction, the dispenser assembly may include one or more movable cutting mechanisms 160 to allow for at least partially cutting, perforating, or otherwise creating a line of separation, at or along a selected portion of the sheet material 12 after a desired or prescribed length of the sheet material has been dispensed or fed. FIG. 18 shows an example cutting mechanism that is disposed or positioned within the feed roller. The cutting mechanism can be configured to move or be actuated at a prescribed or preset point during a revolution of the feed roller, or after a prescribed rotation of the feed roller so as to selectively cut or perforate the sheet material after a desired or prescribed length or portion of the sheet material has been fed or dispensed. For example, the cutting mechanism 160 may be supported within the body 40 of the feed roller 18 and can be at least partially extensible/retractable into and out of the body of the feed roller through an opening, aperture, or slot 162 defined therein as indicated in FIG. 18, with the rotation of the feed roller to selectively cut or perforate the prescribed length or amount of sheet material 12 after it has been pulled or fed from the supply roll for dispensing. The cutting mechanism can include a cutting blade 164 with a cutting edge or series of teeth 166 formed/arranged therealong, and which blade can be movably supported or otherwise coupled to the feed roller body. Embodiments of the present disclosure described herein can also utilize concepts disclosed in commonly-owned U.S. patent application Ser. Nos. 15/185,937 and 15/848,643 which are incorporated by reference herein in their entireties.

Figure 19:
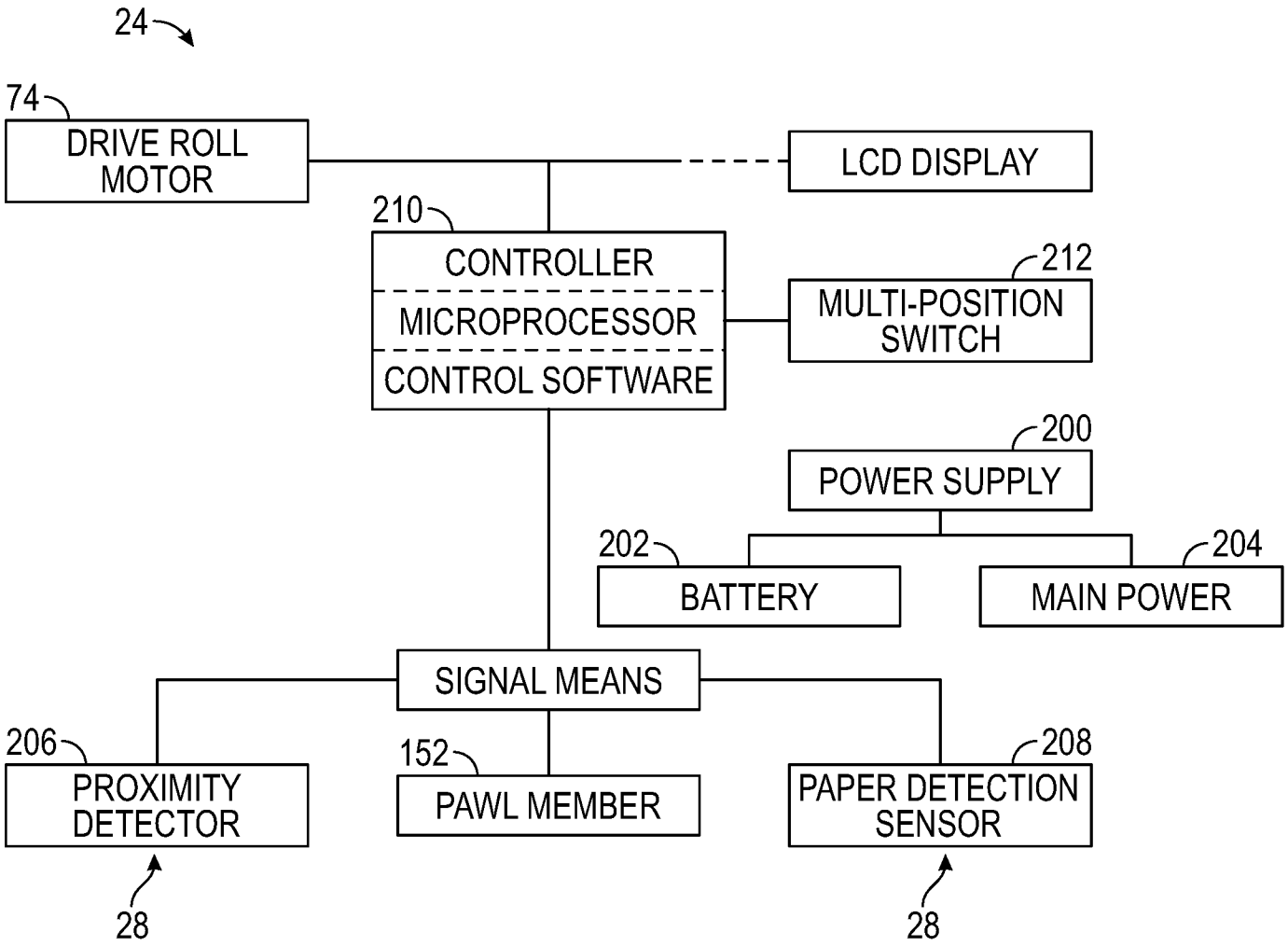
FIG. 19 shows a block diagram of an example of a control system in communication with the dispenser assembly according to one aspect of the present disclosure.

FIG. 19 illustrates a block diagram of an electronic control system or circuit 24 for operating the dispenser assembly 10 in an exemplary embodiment. The dispenser or operative components of the dispenser may be powered by a power supply 200 such as one or more batteries 202 contained in a battery compartment, though any suitable battery storage device may be used for this purpose. Alternatively, or in addition to battery power, the dispenser may also be powered by a building's alternating current (AC) distribution system as indicated at 204. For this purpose, a plug-in modular transformer/adapter could be provided with the dispenser, which connects to a terminal or power jack port located, for example, in the bottom edge of the circuit housing for delivering power to the control circuitry and associated components. The control circuit also may include a mechanical or electrical switch that can isolate the battery circuit upon connecting the AC adapter in order to protect and preserve the batteries.

In one example embodiment of an electronic dispenser, a sensor 28, such as a proximity detector or other suitable sensor 206, may be configured to detect an object placed in a detection zone external to the dispenser to initiate operation of the dispenser. This sensor may be a passive sensor that detects changes in ambient conditions, such as ambient light, capacitance changes caused by an object in a detection zone, and so forth. In an alternate embodiment, the sensor 28 may be an active device and include an active transmitter and associated receiver, such as one or more infrared (IR) transmitters and an IR receiver. The transmitter transmits an active signal in a transmission cone corresponding to the detection zone, and the receiver detects a threshold amount of the active signal reflected from an object placed into the detection zone. The control system circuitry generally will be configured to be responsive to the sensor for initiating a dispense cycle upon a valid detection signal from the receiver. For example, the proximity sensor 206 or other detector can be used to detect both the presence of a user's hand. The dispenser can additionally include a paper detector sensor 208, such as one or more infrared emitters and infrared detectors with one infrared emitter/detector, pair aligned to detect a user's hand below the dispenser 10 and the second infrared emitter/detector pair aligned to detect a sheet hanging below the outermost front edge of the discharge chute.

The dispenser controller or processor 210 can control activation of the dispensing mechanism upon valid detection of a user's hand for dispensing a measured length of the sheet material 12. In one embodiment, the control circuit can track the running time of the drive motor 74 of the motorized feed roller, and/or receive feedback information directly therefrom indicative of a number of revolutions of the feed roller and correspondingly, an amount of the sheet material feed thereby. In addition, or as a further alternative, sensors and associated circuitry may be provided for this purpose. Various types of sensors can include IR, radio frequency (RF), capacitive or other suitable sensors, and any one or a combination of such sensing systems can be used. The control system 24 also can control the length of sheet material dispensed. Any number of optical or mechanical devices may be used in this regard, such as, for example, an optical encoder may be used to count the revolutions of the drive or feed roller, with this count being used by the control circuitry to meter the desired length of the sheet material to be dispensed.

The processing logic for operation of the electronic dispenser in, for example, the hand sensor and butler modes, can be part of the control software stored in the memory of the microprocessor in the control system 24. One or more binary flags are also stored in memory and represent an operational state of the dispenser (e.g., "paper cut" set or cleared). An operational mode switch in dispenser sets the mode of operation. In the hand sensor mode, the proximity (hand) sensor detects the presence of a user's hand below the dispenser and in response, the motor 74 is operated to dispense a measured amount of sheet material 12. The control circuit can then monitor when the sheet of material is removed. For example, actuation of the pawl member 152 or triggering/activation of a paper detection sensor 208 can determine the removal of paper and reset the hand sensor. The proximity sensor 206 also can be controlled to not allow additional sheet material to be dispensed until the proximity sensor is reset. If the proximity sensor 206 detects the presence of a user's hand but does not dispense sheet material, the control circuit can check for sheet material using the paper detection sensor 208. If sheet material 12 has not been dispensed (i.e., no sheet material is hanging from the dispenser), the motor 74 will be activated to dispense a next sheet.

A multi-position switch 212 also can be provided to switch the dispenser operation between a first or standard operation mode and a second mode, such as a butler mode. In such butler mode, the proximity sensor 208 for detecting the presence of a user's hand/object can be deactivated, and the controller 24 can automatically dispense sheet material when the cover is closed and the dispenser is put into operation. The paper detection sensor 208 further can determine if a sheet is hanging from the dispenser. If sheet material is hanging, the control circuit will then monitor when the sheet of material is removed. For example, a cutting mechanism movement detector, which may be arranged and configured to detect actuation or movement of the cutting mechanism; the pawl member; and/or the paper detection sensor can determine the removal of paper and reset the dispenser. The next sheet will be dispensed automatically. If the paper detection sensor 158 determines the absence of hanging sheet material, the motor 74 will be activated to dispense the next sheet. The control circuit will then determine if the sheet has been removed before dispensing another sheet.

In one embodiment, the dispenser assembly 10 is operative in a first mode to be responsive to a signal from the proximity sensor to dispense a sheet of material. The dispensing mechanism is operative in a second mode to dispense a next sheet in response to the signal means being activated by movement of the cutting mechanism or tear bar to its extended position in response to dispensed sheet material 12 being removed from the dispenser. In another embodiment, the dispenser 10 can be operative in a second mode to dispense a next sheet in response to a signal means being activated by movement of the cutting mechanism, and a signal from a paper detection sensor 208 that the sheet material 10 has been removed from the dispenser. Such a sensor can be affixed to an external surface of the discharge chute rather than inside the discharge chute.

The dispenser 10 generally can dispense a measured length of the sheet material, which may be accomplished by various means, such as a timing circuit that actuates and stops the operation of the motor driving the feed roller after a predetermined time. In one embodiment, the drive motor 74 of the drive or feed roll can provide direct feedback as to the number of revolutions of the feed roller, indicative of an amount of the sheet material fed thereby. Alternatively, a motor revolution counter can be provided that measures the degree of rotation of the drive rollers and is interfaced with control circuitry to stop a drive roller motor after a defined number of revolutions of the feed rollers. This counter may be an optical encoder type of device, or a mechanical device. The control circuitry may include a device to allow maintenance personnel to adjust the sheet length by increasing or decreasing the revolution counter set point. The multi-position switch 212 can also be in operable communication with the control circuit to select one of a plurality of time periods as a delay between delivery of a first sheet and delivery of a next sheet to the user. Embodiments of the present disclosure described herein can also utilize concepts disclosed in commonly-owned U.S. Pat. No. 7,213,782 entitled "Intelligent Dispensing System" and U.S. Pat. No. 7,370,824 entitled "Intelligent Electronic Paper Dispenser," both of which are incorporated by reference in their entireties herein.

The foregoing description generally illustrates and describes various embodiments of the present invention. It will, however, be understood by those skilled in the art that various changes and modifications can be made to the above-discussed construction of the present invention without departing from the spirit and scope of the invention as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present invention. Accordingly, various features and characteristics of the present invention as discussed herein may be selectively interchanged and applied to other illustrated and non-illustrated embodiments of the invention, and numerous variations, modifications, and additions further can be made thereto without departing from the spirit and scope of the present invention as set forth in the appended claims.

What is claimed is:

1. A dispenser, comprising:

a dispenser housing;

a supply of sheet material supported within the dispenser housing;

a feed roller adjacent the supply of sheet material, the feed roller having a body configured to engage and move sheet material from the supply of sheet material along a path for discharge of the sheet material from the dispenser housing;

a feed roller drive assembly coupled to the feed roller and configured to drive rotation of the feed roller, the feed roller drive assembly comprising:

a drive motor located within the dispenser housing adjacent the feed roller;

a drive belt extending between the drive motor the body of the feed roller, wherein the drive belt is operatively connected to the body of the feed roller at a position between a first end and a second end of the body of the feed roller for transferring power from the drive motor to the feed roller for rotation of the feed roller; and at least one biasing member coupled to the drive belt or to the drive motor, the at least one biasing member configured to apply a biasing or tension force along the drive belt sufficient to deter slippage of the drive belt and/or dampening of vibrations from operation of the dispenser; and a controller in communication with the drive motor, the controller including programming configured to drive rotation of the feed roller in response to a signal, wherein the controller controls operation of the drive motor to drive the drive belt to cause rotation of the feed roller sufficient to feed a selected length of the sheet material from the supply of sheet material for discharge from the dispenser housing.

2. The dispenser of claim 1, wherein the drive belt is operatively coupled to the feed roller at a substantially intermediate point between the first end and the second end of the feed roller to facilitate application of a substantially consistent drive force along the feed roller.

3. The dispenser of claim 1, further comprising one or more pressing rollers biased toward engagement with the feed roller to engage and press the sheet material against the feed roller.

4. The dispenser of claim 1, wherein the feed roller drive assembly further comprises a drive motor pulley operatively attached to a driveshaft of the drive motor, and wherein the drive belt is received about and engages the feed roller and the drive roller pulley for driving rotation of the feed roller.

5. The dispenser of claim 1, wherein the feed roller drive assembly further comprises a feed roller pulley at least partially positioned within a circumferential groove defined along the body of the roller and engaged by the drive belt.

6. The dispenser of claim 1, wherein the drive motor is located within a chamber defined within the dispenser housing so as to substantially reduce ambient noise heard or experienced outside the dispenser housing due to operation of the motor.

7. The dispenser of claim 1, further comprising:

a tensioner bracket movably mounted with the dispenser housing;

a roller connected to the tensioner bracket and configured to engage the drive belt; and wherein the at least one biasing member urges the roller into engagement with the drive belt to apply the biasing or tension force to the drive belt, wherein the biasing or tension force is adjustable to provide a substantially consistent tension along the drive belt.

8. The dispenser of claim 1, further comprising:

a tensioned motor mounting assembly including:

a support frame at least partially supporting the drive motor;

a base movably mounted to the dispenser housing and connected to the support frame so as to moveably couple the drive motor to the dispenser housing; and wherein the at least one biasing member is coupled to the base or the support frame and is configured to bias the tensioned motor mounting assembly in a direction away from the feed roller to apply the biasing or tension force along the drive belt.

9. The dispenser of claim 8, further comprising:

a bearing assembly coupled to the base and at least partially supporting a portion of a driveshaft of the drive motor sufficient to substantially inhibit bending or twisting of the driveshaft during operation of the feed roller drive assembly.

10. A dispenser, comprising:

a dispenser housing;

a supply of sheet material received within the dispenser housing;

a feed roller rotatably mounted along the dispenser housing adjacent the supply of sheet material so as to receive and feed sheet material from the supply of sheet material along a discharge path; and a feed roller drive assembly including a drive motor, and a belt transmission assembly having a drive belt coupled to drive motor and to the feed roller, the drive belt being at least partially received within a circumferential groove defined along the feed roller;

wherein a feed roller pulley is at least partially positioned within the circumferential groove defined along the feed roller and is configured to be engaged by the drive belt for transferring power from the drive motor to the feed roller such that rotation of the drive belt by the drive motor causes rotation of the feed roller;

wherein the drive motor is selectively actuated to rotate the feed roller sufficient to feed an amount of sheet material from the supply sheet material sufficient for discharge of a selected length of sheet material from the dispenser housing.

11. The dispenser of claim 10, wherein the feed roller comprises a feed roller body having a first end, a second end, and an outer surface, and wherein the drive belt is operatively connected to the feed roller body approximately intermediate the first and second ends of the feed roller body.

12. The dispenser of claim 10, the feed roller drive assembly further comprising a drive motor pulley operatively attached to a driveshaft of the drive motor; and wherein the drive belt is at least partially received about and operably engages the drive motor pulley.

13. The dispenser of claim 10, wherein the drive motor is received within a chamber defined within the dispenser housing to substantially reduce ambient noise heard or experienced outside the dispenser housing during operation thereof.

14. The dispenser of claim 10, further comprising a tensioned motor mounting assembly including a base movably mounted to the dispenser housing; a support frame that is connected to the base, and at least partially supports the drive motor; and one or more biasing members connected to the base or the support frame to bias the tensioned motor mounting assembly for providing tension along the drive belt and/or for providing dampening for the feed roller drive assembly.

15. The dispenser of claim 10, further comprising a tensioner bracket movably mounted with the dispenser housing; a roller connected to the tensioner bracket and configured to engage the drive belt; and at least one biasing member adapted to urge the roller into engagement with the drive belt so as to apply a biasing or tension force to the drive belt; and wherein the biasing or tension force is adjustable to provide a substantially consistent tension along the drive belt.

16. The dispenser of claim 10, further comprising a control system, wherein the control system comprises a plurality of sensors arranged along the dispenser housing and configured to detect a user and/or removal of a length of sheet material to initiate a dispensing operation.

17. The dispenser of claim 16, wherein the plurality of sensors further comprise a paper detection sensor adjacent the discharge and configured to detect absence of a hanging sheet of material in the discharge.

18. The dispenser of claim 10, further comprising a bearing located adjacent the drive motor in a position so as to receive and at least partially support a portion of a driveshaft of the drive motor to substantially prevent, reduce, or inhibit bending or twisting of the driveshaft or components of the feed roller drive assembly.

19. The dispenser of claim 10, further comprising one or more pressing rollers biased toward engagement with the feed roller to engage and press the sheet material against the feed roller.

20. The dispenser of claim 10, further comprising a controller in communication with the drive motor, the controller including programming configured to drive rotation of the feed roller in response to a signal, wherein the controller controls operation of the drive motor to drive the drive belt to cause rotation of the feed roller sufficient to feed a selected length of the sheet material from the supply of sheet material for discharge from the dispenser housing.

* * * * *